US007441530B2

(12) United States Patent
Tinker

(10) Patent No.: US 7,441,530 B2
(45) Date of Patent: Oct. 28, 2008

(54) OPTIMAL HEAT ENGINE

(75) Inventor: Frank A. Tinker, Tucson, AZ (US)

(73) Assignee: FSNC, LLC, Tucson, AZ (US)

( * ) Notice: Subject to any disclaimer, the term of this patent is extended or adjusted under 35 U.S.C. 154(b) by 484 days.

(21) Appl. No.: 11/129,783

(22) Filed: May 16, 2005

(65) Prior Publication Data

US 2006/0124100 A1 Jun. 15, 2006

Related U.S. Application Data

(60) Provisional application No. 60/635,593, filed on Dec. 13, 2004.

(51) Int. Cl.
*F02B 75/32* (2006.01)

(52) U.S. Cl. ..... 123/197.4; 123/197.1

(58) Field of Classification Search ..... 123/197.4, 123/197.1; 92/13.51

See application file for complete search history.

(56) References Cited

U.S. PATENT DOCUMENTS

| | | | | |
|---|---|---|---|---|
| 4,319,546 | A * | 3/1982 | Beden | 123/19 |
| 4,938,192 | A * | 7/1990 | Pusic et al. | 123/432 |
| 5,755,195 | A * | 5/1998 | Dawson | 123/197.4 |
| 6,453,869 | B1 * | 9/2002 | Moore | 123/197.4 |
| 6,564,762 | B2 * | 5/2003 | Dow | 123/78 F |
| 6,701,885 | B2 * | 3/2004 | Klomp et al. | 123/197.4 |
| 6,857,412 | B2 * | 2/2005 | Ozdamar | 123/197.1 |
| 6,990,944 | B2 * | 1/2006 | Ozdamar | 123/197.1 |
| 2002/0073954 | A1 * | 6/2002 | Han | 123/197.4 |

* cited by examiner

*Primary Examiner*—Stephen K. Cronin
*Assistant Examiner*—Jason Benton
(74) *Attorney, Agent, or Firm*—Anotonio R. Durando

(57) ABSTRACT

A conservative force coupled to the piston of a reciprocating-piston engine, refrigerator, or compressor acts to counter the pressure force on the piston that arises from the change of volume of the working substance accompanying a change in the piston position. As a result, the efficiency of the engine, refrigerator, or compressor is improved to approach the theoretical thermodynamic limit of the underlying process.

76 Claims, 25 Drawing Sheets

OPTIMAL HEAT ENGINE

RELATED APPLICATIONS

This application is based on U.S. Provisional Application Ser. No. 60/635,593, filed Dec. 13, 2004.

BACKGROUND OF THE INVENTION

1. Field of the Invention

The invention relates, in general, to reciprocating machines for converting thermal energy into mechanical force or, conversely, using mechanical work to transfer thermal energy from one region to another. In particular, the invention relates to mechanisms designed to produce position-dependent conservative forces to counter the conservative forces that arise from the change in volume of the machine's working medium.

2. Description of the Prior Art

Conservative forces are defined as those forces that are a direct result of a potential energy field and, therefore, are a function only of position. As a consequence, it is sufficient and necessary that they derive from the gradient of a potential energy function. The work a conservative force does on an object in moving it from point A to B is path independent—i.e., it depends only on the end points of the motion. For example, the force of gravity and the spring force are conservative forces owing to their dependence only on a parameter of position. By contrast, a spinning flywheel represents kinetic energy that is a function not of its orientation, but of a change in its orientation as a function of time. Therefore, a force resulting from a spinning flywheel cannot be the gradient of a potential energy function and, subsequently, cannot be a conservative force. Other examples include dissipative forces such as friction and air-resistance which are independent of the direction of travel and, therefore, cannot derive from the gradient of a function.

In broad terms, a reciprocating machine consists of a device that includes a moveable member, such as a piston, subject to a variety of configurational forces. Most reciprocating machines are designed to perform a particular function and their functionality is the main focus of machine design. When efficiency is of concern, the design is normally optimized by reducing frictional forces and heat losses while retaining the desired functionality of the machine.

Reciprocating heat engines are characterized by forces arising from the compression or decompression of the working medium in response to a displacement of the reciprocating member, i.e., the piston. The working medium may take the form of a gas, such as air or a fuel-air mixture, a liquid, a solid, or any combination thereof. If the reciprocating motion is periodic in nature, that is predictable as to the location of the reciprocating member as a function of time, then the forces are equally so and the result is a force that can be determined solely by the location of the reciprocating member. This meets the requirement of being a conservative force. The effect of these conservative forces on the efficiency of a heat engine has been traditionally, and pointedly, ignored in conventional engine-performance analysis and design on the seemingly realistic assumption that the cyclical nature of the process eliminates any net effect. This invention is based on the discovery that this assumption is in error.

The efficiency of reciprocating heat engines is analyzed conventionally using the applicable laws of thermodynamics. Referring to FIG. 1, wherein a generic reciprocating machine, HE, converting heat Q into work W is illustrated schematically, the first law of thermodynamics requires that $$Q=W+dE, \tag{1}$$

where E is the internal energy of the system (from F. Reif, *Fundamentals of Statistical and Thermal Physics*, McGraw-Hill, New York, 1965, pp. 186-187). Equation 1 defines a differential energy-balance requirement governing all thermodynamic processes. Since, by definition, each cycle begins and ends in the same thermodynamic state, the internal energy of the system (a state function) must be the same at the completion of each cycle (that is, $\Delta E=0$ for the cycle). This leads to the theorem of Poincaré regarding cyclical processes, $$\begin{aligned} &\Delta Q=\Delta W \\ &\Delta Q=Q_{in}-Q_{out} \\ &\Delta W=W_{out}-W_{in} \end{aligned} \tag{2}$$

(See Kalyan Annamalai and Ishwar K. Puri, *Advanced Thermodynamics Engineering,* CRC Press, Boca Raton (2002) p. 65).

The efficiency of such a cyclical process is defined as the ratio of the net useful energy change produced to the energy input required to produce that change. For engines, the input consists of heat, $Q_{in}$, and the output is the net work, $\Delta W$, performed by the engine. Therefore, engine efficiency is given by $$\in = \frac{\Delta W}{Q_{in}} = \frac{\Delta Q}{Q_{in}} = \frac{Q_{in}-Q_{out}}{Q_{in}} = 1-\frac{Q_{out}}{Q_{in}}. \tag{3}$$

The cyclical operation of heat engines has been traditionally analyzed using pressure-volume (PV) diagrams, as illustrated in FIG. 2. Heat engines operate clockwise around the diagram while refrigerators and compressors proceed counter-clockwise. With reference to engines, segment I of the cycle depicted in the figure, which is a realistic hybrid of the ideal Otto and Diesel cycles described in the literature, corresponds to the adiabatic compression of the working medium in the engine. Segment II is an increase in pressure caused by the heating of the working medium under constant volume conditions. In internal combustion engines, segment II is associated with the Otto-cycle, spark-ignition of the fuel-air mixture that comprises the working medium. Segment III represents heating of the working medium where expansion and heat addition are balanced to maintain constant pressure. This is associated with the injection-controlled fuel burning phase of Diesel-cycle internal combustion engines. Segment IV corresponds to the adiabatic expansion of the working medium caused by the very high pressure produced by the heating of the working medium. Finally, segment V is the constant-volume reduction in the pressure and temperature of the working medium to return it to its initial state. This segment is identified with the process of exhausting spent fuel and replacing it with a fresh fuel-air mixture in internal combustion engines.

Based on the PV diagram of FIG. 2, those skilled in the art will readily recognize that work is performed during segments I, III and IV of the cycle, while heat/material is transferred in segments II, III and V. According to the integral definition of work, $$W_{in} = W_I = \int_{V_1}^{V_2} p\,dV, \tag{4}$$

-continued $$W_{out} = W_{III} + W_{IV} = \int_{V_3}^{V_4} p\,dV + \int_{V_4}^{V_5} p\,dV, \text{ and} \tag{5}$$

$$\Delta W = W_{out} - W_{in} = W_{III} + W_{IV} - W_I = \oint p\,dV, \tag{6}$$

where the work subscript corresponds to the area under the matching section of the curve.

It is also understood in the art, as specified in Equation 6, that the area enclosed by the diagram measures the net work done in a cycle. This has been historically interpreted as being consistent with the notion that conservative forces have no net effect on the efficiency of the system. That is, since the work associated with the area under the segment labeled I is common with the work associated with segments III and IV, but opposite in sign, its contribution to the total work done in a cycle is reduced to zero. Therefore, it has been considered not to have any effect on the efficiency of the system.

The Otto-cycle engine, typically implemented as today's spark-ignition gasoline engine, is analyzed, under an ideal implementation, as if points 3 and 4 of the curve of FIG. 2 were coincident. Similarly, the ideal Diesel cycle is assumed to have coincident points 2 and 3. Both ideal cases are only theoretical in nature, with actual operation of either engine tending more toward the mixed case shown in the figure.

The compression ratio of a reciprocating piston engine is defined as $$r_c = \frac{V_1}{V_2}, \tag{7}$$

where $V_1$ and $V_2$ are the maximum and minimum volumes, respectively, assumed by the working medium during a cycle of operation. Assuming a ratio, $\gamma$, of constant-pressure to constant-volume specific heats of the working medium ($\gamma = c_p / c_V$), it can be shown that the maximum attainable efficiency of such an engine is given by $$\epsilon_{trad} = 1 - r_c^{1-\gamma}. \tag{8}$$

Based on Equation 8, engine designers have stressed for decades the goal of maximizing the compression ratio of the engine in order to achieve the greatest engine efficiency. Unfortunately, increasing the compression ratio is not without difficulty in an internal combustion engine because fuel tends to spontaneously ignite at relatively low values of compression. Thus, the initial work to maximize the efficiency of the Otto-cycle engines emphasized the development of fuel additives that served to increase the compression ratio at which this spontaneous combustion occurred. Alternatively, Diesel-cycle engines maximize the compression ratio by injecting fuel after maximum compression is reached, which in turn produces spontaneous combustion of the fuel. By injecting droplets of fuel, as opposed to a gaseous fuel/air mixture, the fuel burns fairly slowly, thereby producing a roughly constant-pressure burning characteristic corresponding to the conditions of segment III in FIG. 2.

Such efforts at maximizing compression ratios to optimize the efficiency of internal combustion engines were essentially exhausted by the time of the oil crisis in the 1970s. Therefore, engineers turned to the next most well-known impediment to engine efficiency; that is, the incomplete burning of the fuel introduced into the engine. To that end, engines were equipped with fuel-injection systems that could be computer-controlled to optimize the quantity of fuel used based on data obtained from exhaust sensors in order to minimize the unburned or partially-burned fuel fraction. The results obtained from these technologies were further augmented by high-energy ignition systems and combustion-chamber structures that promoted complete burning of the injected fuel.

FIG. 3 shows efficiency data (the square data points 14 are from R. V. Kerley and K. W. Thurston, *The Indicated Performance of Otto-Cycle Engines*, SAE Technical Papers #620508, 1962; the round data points 16 are from D. F. Caris and E. E. Nelson, *A New Look at High Compression Engines,* SAE Technical Papers #590015, 1959.) and the predictive curves of the theoretical air-cycle and fuel/air-cycle models all as a function of compression ratio. The air-cycle curve 10 is simply a plot of Equation 8 using a value of 1.34 for the ratio-of specific heats as extracted from Caris, et al. for a compression ratio of 19.5:1 while the fuel/air-cycle curve 12 is obtained using varying ratios of specific heats that depend on the pre- and post-ignition constituents of the working medium, the heat of combustion of the fuel-air mixture, and an iterative estimation of the residual fuel, or mass fraction, for a cycle consistent with the conditions of the experiments. As is immediately evident from FIG. 3, the theoretical estimates provide only a qualitative relationship with the data.

There has been little recent debate in the art over the discrepancy between the theoretical curves of FIG. 3 and the experimental results. The consensus view has been that it is primarily due to unintentional heat losses through the cylinder walls of the engine. Accordingly, efforts to mitigate these losses have been made using ceramic materials with low thermal conductivity to insulate the cylinder walls. Another discrepancy between the theoretical curves and the experimental data was noted by Caris, et al. [Caris, et al. (1959)]. It lies in an apparent 17:1 compression-ratio efficiency peak that is found in the experimental data but is not predicted by the theoretical curves. The theory behind both curves 10, 12 predicts that efficiency will continue to increase with the compression ratio—not that it will peak and then decline, as shown by the experimental data.

In view of the foregoing, the accepted notion in the art has been that all parameters affecting the thermodynamic efficiency of combustion engines are well understood and that further improvements can only be achieved through incremental enhancements to the existing structures and materials already in use, rather than a better theoretical understanding of the fundamental processes involved. Therefore, any approach that might produce an improvement in the efficiency of reciprocating heat engines based on novel theoretical considerations would constitute a breakthrough in the art.

BRIEF SUMMARY OF THE INVENTION

The present invention is based on a novel approach with regard to the conservative forces arising from the operational cycle of reciprocating heat engines and the realization that greater efficiencies can be achieved by coupling the work-producing member of the engine to an appropriately counteracting mechanism adapted to balance these forces over a range of motion of that member. The invention is derived from a refined view of the analysis of the mixed cycle illustrated in FIG. 2, as detailed below.

By definition, the input heat required by an engine to obtain a net amount of work over a cycle (see Equation 3) is given by $$Q_{in} = \frac{\Delta W}{\epsilon}. \tag{9}$$

ΔW may be viewed as comprising multiple components, $W_k$, each corresponding to different portions of the total work provided by the engine (such as the to the water pump, the flywheel, etc.). Accordingly, Equation 9 may be written as $$Q_{in} = \sum_k Q_k = \sum_k \frac{W_k}{\epsilon}. \tag{10}$$

wherein the subscript k refers to individual work components, $W_k$, and to the amount of heat input, $Q_k$, required to perform that component of work. So, for any particular component of the total work output, the corresponding heat requirement can be calculated on the basis of the engine's efficiency using the equation $$Q_k = \frac{W_k}{\epsilon}. \tag{11}$$

Referring back to the mixed-cycle process represented by the PV diagram of FIG. 2, one identifies the efficiency of operation by equating the input energy required to complete the cycle and the output energy that results. Particular attention should be paid to the initial phase of the cycle where the working substance is compressed from point 1 to point 2 along segment I of the curve. Since this compression is not accomplished though any outside means, it can only result from energy introduced into the system during previous cycles of operation of the engine. If the work done along segment I of the diagram is identified as $W_I$, and it is acknowledged that $W_I$ results from previous engine cycles wherein heat is converted to work with efficiency ϵ, then the heat required to perform $W_I$, as derived from Equation 11, is given by $$Q_I = \frac{W_I}{\epsilon}. \tag{12}$$

In essence, $Q_I$ is the heat input required by the engine to perform the work of compressing the working medium associated with segment I of the process curve.

During the current cycle, heat, indicated as $Q_{in}$ is introduced in segments II and III of the PV diagram. Thus, $Q_{in}=Q_{II}+Q_{III}$ is the quantity of heat added to the system during the cycle while $Q_I$ is the quantity of heat required from previous cycles to compress the working medium. The sum of these heats is the total input heat energy required to complete the cycle:

$$Q_{II} + Q_{III} + Q_I = Q_{in} + \frac{W_I}{\epsilon}. \tag{13}$$

Identifying the work output along segments III and IV as $W_{III}$ and $W_{IV}$, respectively, the heat exhausted in section V as $Q_{out}=Q_V$, and recalling the specification of Equation 6, the total energy output from the cycle is given by $$Q_V+W_{III}+W_{IV}=Q_{out}+W_{III}+W_{IV}=Q_{out}+\Delta W+W_I \tag{14}$$

Equating the required input energy and the resulting output energy of Equations 13 and 14, respectively, provides $$Q_{in} + \frac{W_I}{\epsilon} = Q_{out} + \Delta W + W_I. \tag{15}$$

Moreover, the process efficiency of Equation 3 provides the identity $$Q_{in}-Q_{out}=\epsilon Q_{in}, \tag{16}$$

which, when substituted into Equation 15, results in $$\epsilon\, Q_{in} + \left(\frac{1}{\epsilon} - 1\right)W_I - \Delta W = 0. \tag{17}$$

Equation 17 may be manipulated into quadratic form as $$Q_{in}E^2-(\Delta W+W_1)\epsilon+W_1=0, \tag{18}$$

or, recalling Equations 4 through 6, $$Q_{in}\epsilon^2-W_{out}\epsilon+W_{in}=0. \tag{19}$$

Finally, solving Equation 19 for the efficiency term using the standard quadratic solution yields $$\epsilon = \frac{W_{out}}{2\cdot Q_{in}}\left[1 \pm \sqrt{1 - \frac{4\cdot Q_{in}\cdot W_{in}}{W_{out}^2}}\right]. \tag{20}$$

Equation 20 is markedly different from Equation 3 above in its prediction of efficiency. On the other hand, the two equations reduce to the same identity if $W_{in}$ is reduced to zero. This means that the difference is entirely attributable to the assumption made herein, in direct opposition of traditional view, that the compression/decompression of the working substance produces a net energy loss, $$E_{lost} = \left(\frac{1}{\epsilon} - 1\right)\cdot W_I, \tag{21}$$

which is accounted for in the derivation provided above. That is, the term $W_I$ associated with the energy required to compress the working medium during the compression stroke (segment I) of reciprocating heat engines has been intentionally ignored in the prior-art analysis of the cycle on the assumption that it does not affect the efficiency of the cycle As illustrated in FIG. 4*a* and 4*b*, the efficiency solution of Equation 20 successfully tracks the experimental data, even to the extent of the 17:1 compression ratio peak reported by Caris, et al., (FIG. 4*b*) thereby verifying that the disparity between the traditionally predicted efficiencies and those achieved in practice are, in fact, due to a loss of energy associated with the work required to compress the working fluid. In fact, therefore, in opposition to the theory currently accepted as fact, the refined analysis of this disclosure shows that $W_I$ is a relevant factor that needs to be considered in heat engine design. As a result, $W_I$ provides a unique opportunity for further improvements in the ever-important efforts to improve the efficiency of reciprocating heat engines.

In light of the state of the art and the discovery described above, it is the object of this invention to increase the efficiency of heat engines by minimizing the work performed by the engine in compressing the working substance. This is achieved by coupling the engine to a conservative force mechanism that cyclically stores and returns potential energy to the engine. In particular, the invention exploits the physical relationship expressed in Equation 20 to develop a generic mechanism capable of performing the work required to drive the reciprocating component of the engine against compression so that the inefficient thermodynamic process does not have to.

Additionally, the trivial derivation $$\varepsilon = \frac{\Delta Q}{W_{in}} = \frac{\Delta W}{W_{in}} = \frac{W_{in} - W_{out}}{W_{in}} = 1 - \frac{W_{out}}{W_{in}}, \tag{22}$$

which employs Poincaré's theorem, Equation 2, to identify the efficiency, $\epsilon$, of compressors and refrigerators, in which work is input and heat/material transfer is desired, shows that these devices will also benefit from the minimization of work done in section I of the curve in FIG. 2 or its general equivalent. This is due to the fact that $W_{out}=W_I$ in counterclockwise navigation of the process curve. Therefore, any technique of reducing the magnitude of $W_I$ is fully applicable to heat engines, refrigerators, or compressors. For simplicity, the term "heat engine" will assume to apply to all of these devices in what follows.

In view of the foregoing, the invention consists of the features hereinafter illustrated in the drawings, fully described in the detailed description of the preferred embodiments, and particularly pointed out in the claims. However, such drawings and descriptions disclose only some of the various ways in which the invention may be practiced.

DETAILED DESCRIPTION OF THE INVENTION

Figure 1:
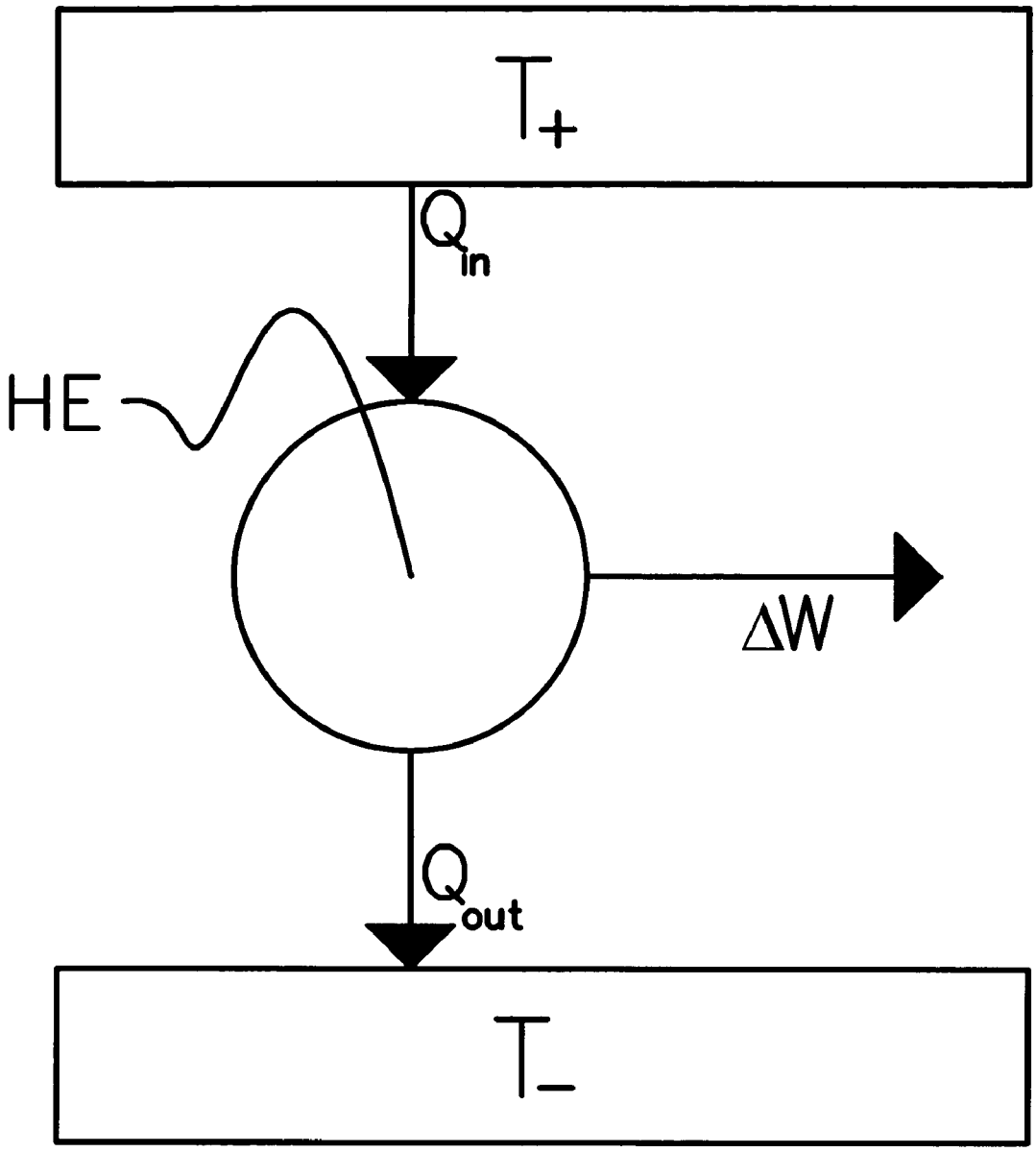
FIG. 1 is a conventional schematic representation of a heat engine.
Figure 2:
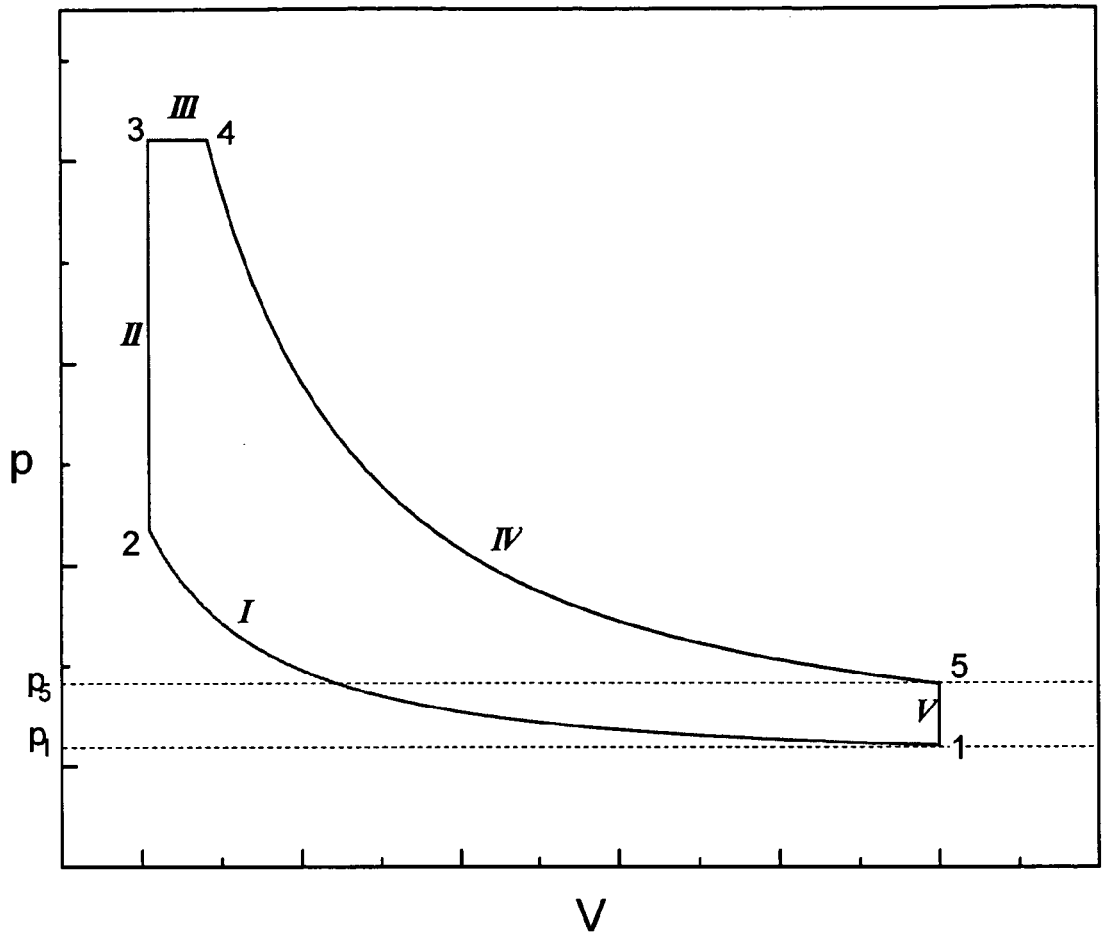
FIG. 2 is a conventional pressure-volume diagram corresponding to a mixed Otto/Diesel cycle.
Figure 3:
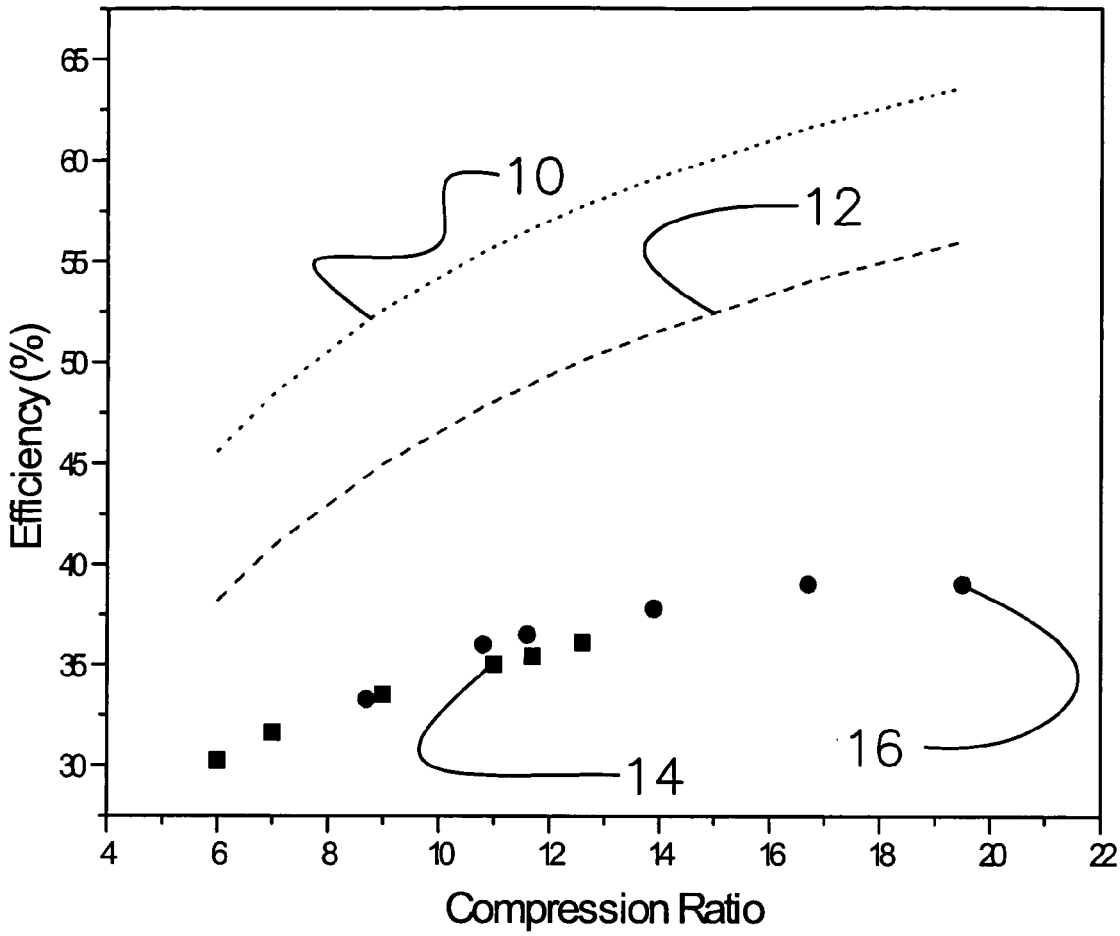
FIG. 3 is a collection of graphs showing efficiency as a function of compression ratio for a theoretical air cycle, for a theoretical fuel/air cycle, and for experimental data.
Figure 4A:
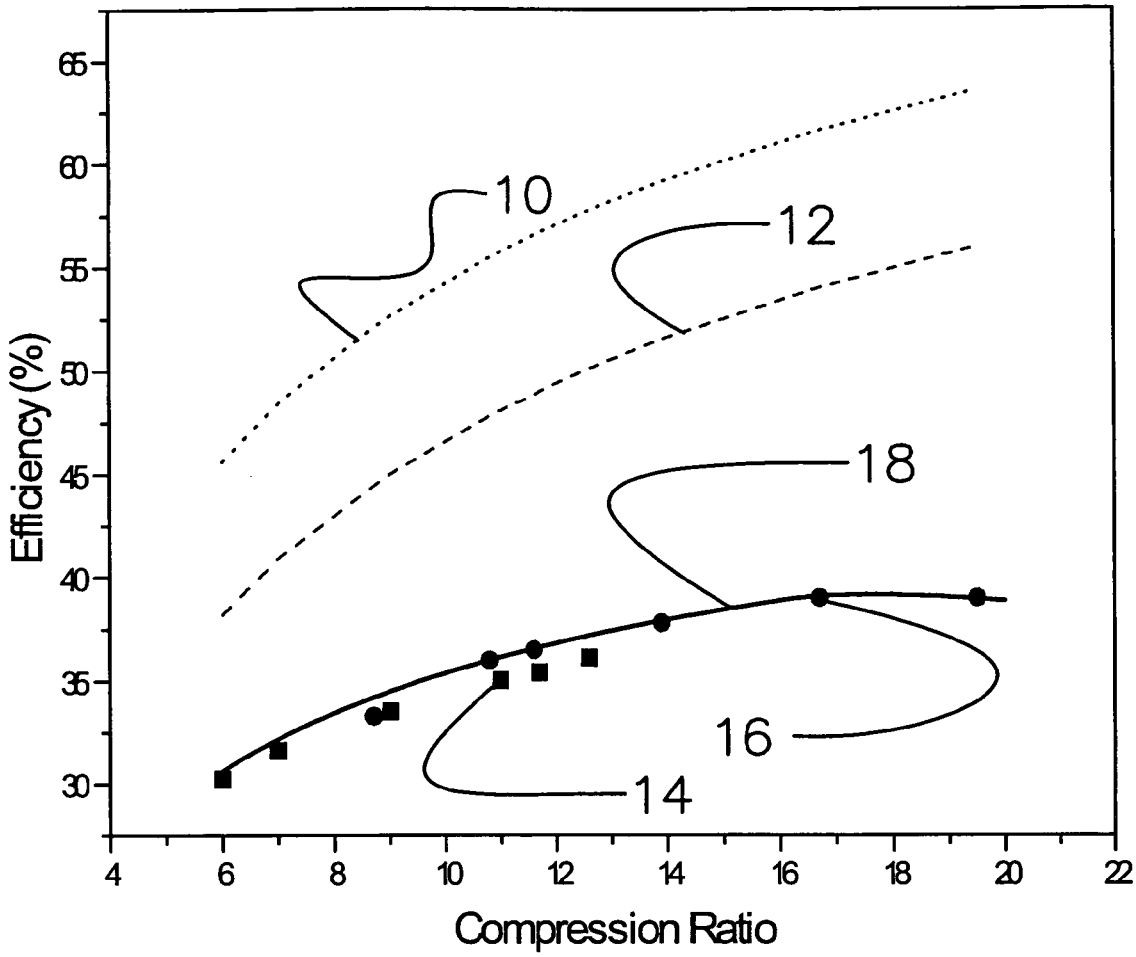
FIG. 4*a* illustrates the theoretical graph of efficiency as a function of compression ratio produced by the revised theory of the invention superimposed over the graphs of FIG. 3.
Figure 4B:
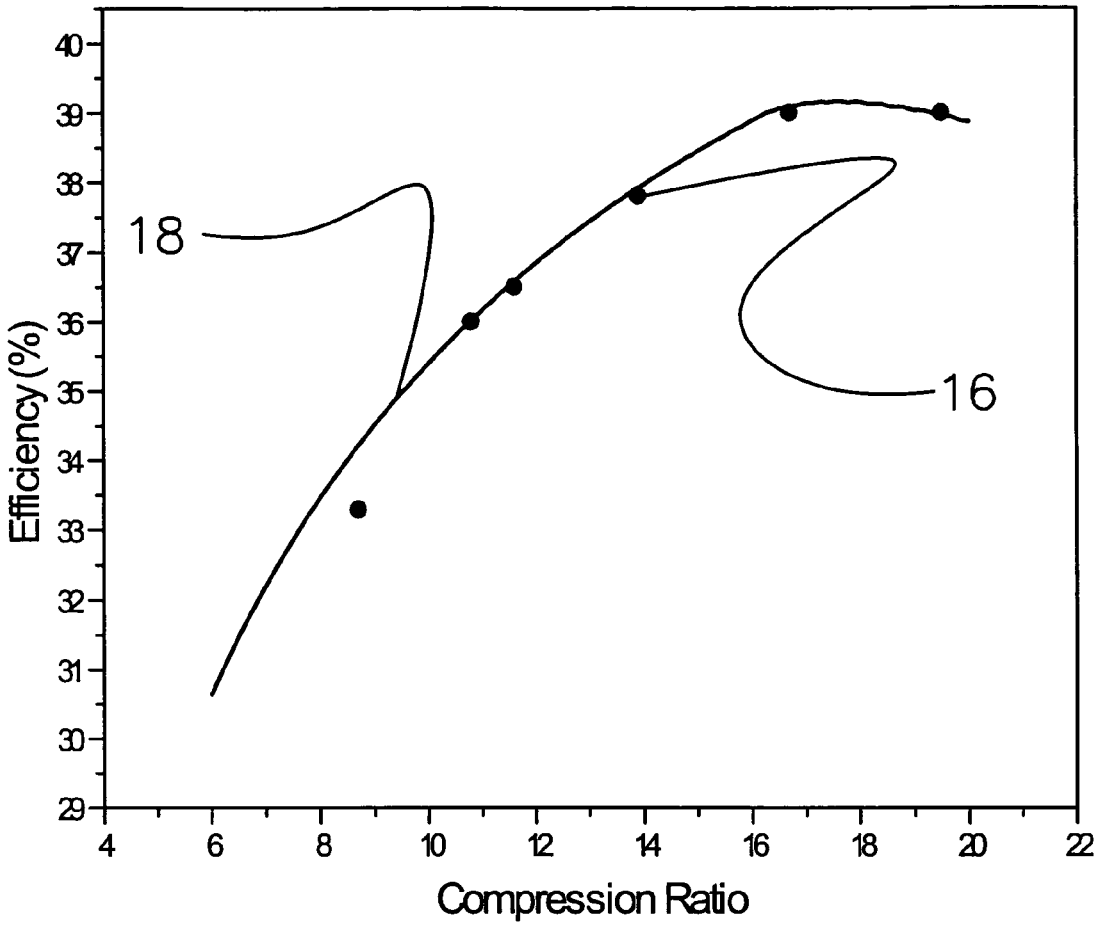
FIG. 4*b* provides a more detailed view of the new theory's success at reproducing the findings of Caris, et al.

The heart of the invention lies in the realization that the presence of an adjunct conservative force in a reciprocating machine can be used advantageously to reduce the energy required of an inefficient source to drive it. In a conventional reciprocating heat engine, in which conservative forces arise from the displacement of a piston or other equivalently moveable member (such as the rotor of a rotary engine) due to change in volume of the working medium of the engine, this reduction is achieved by coupling a supplemental force to the piston over a range of its motion in such a manner as to counterbalance those forces. Without loss of generality, the counterforce may be viewed as a force that pushes the piston into the cylinder with the identical force as a function of position as the force with which the gas repels the piston out of the cylinder.

There are two conceptually general categories of coupling techniques that may be employed to effectively counter these pressure forces. The first, referred to herein as "fixed" coupling, is based on the existence of a conservative force mechanism that can produce, over some range of operation, a nearly exact, but oppositely directed, force, as a function of its displacement, as that arising from the volume change of the working medium in response to the displacement of the piston. If such a mechanism can be identified and implemented, then it is possible to couple the position changes of the piston directly to those of the counterforce device and the sum of the forces will equal zero.

The second technique, referred to herein as "variable" coupling, uses any convenient device capable of providing a conservative force over a given range of operation of the device such that the total work done by that force over that range is equal to the work done by the piston in compressing the working medium over some appropriate range of its motion. To effectively counter the pressure force, the piston must be coupled to the generalized coordinate of the proposed counterforce device in such a way that the infinitesimal work done by the motion of one exactly counters that done by the other over their respective, and corresponding, ranges of motion. Such coupling will, in general, involve a variation as a function of position in the mechanical advantage of the counterforce with respect to the pressure force it is to counter.

Such coupling mechanical advantage is well-known in the art as arising from the general concept of a lever in which a displacement at one end of the coupler corresponds to a different displacement at the other. The action of the lever itself can provide some trigonometric variation in the mechanical advantage it affords. Greater variation in the mechanical advantage can be obtained through a "linkage" in which multiple levers are interconnected and the assembly is used as the coupler. Even greater variation is afforded by allowing the members of a linkage to adjust their interconnections as a function of their relative position.

One implementation of a continuously variable linkage is a cam in which the interconnection is described by the contact point of one linkage member on some geometric surface of another. Without loss of generality, the following will reference "fixed" coupling as "cam-free" and "variable" coupling as "cam-based."

Examining readily available conservative forces, it is apparent that gravitational, deformation, electrostatic, magnetostatic, and pressure forces are good candidates to implement the invention. The gravitational force $F_g(z)$ between the earth and a manageable mass, m, is given by $$F_g(z)=-mg, \tag{1}$$

which is constant over the range of motion of the mass along the z direction. Since this does not substantially match the position dependence required for the invention, gravity is a candidate force mainly for a cam-based implementation.

Springs (wherein forces result from deformation of a material) may be made in a variety of force profiles. The most common profile, however, is one in which the force $F_s(z)$ is linear with respect to the deformation, i.e., $$F_s(z)=-kz. \tag{24}$$

wherein k is the spring constant and z is the direction of deformation. This relation also falls short of reflecting the position dependence required to implement the invention. Therefore, springs are also mainly cam-based implementation candidates.

The force profile $F_e(z)$ of an electrostatic system is inverse quadratic with respect to the separation distance z of the charges, as follows $$F_e(z) = \frac{k}{z^2}. \tag{25}$$

where k is a determinable constant based on the electrostatic charges involved. This force profile can be shown to match that of compression of a working medium only under particular circumstances. Therefore, in general, electrostatic forces are also primarily candidates for a cam-based implementation but may, in certain circumstances, serve in a cam-free implementation.

Pressure forces arise from the compression of some working medium, such as a gas, and are frequently described by $$F_p(z) = k\cdot\left(1+\frac{z}{L}\right)^{-\gamma}, \tag{26}$$

wherein k is a determinable constant, z indicates a change in the separation distance between a piston and the end of a containing cylinder, and γ is a constant frequently, but not exclusively, related to the ratio of specific heats. One may assume that the structure and origin of $F_p(z)$ makes it a candidate for a cam-free compensation mechanism. However, since it intends to counter the compression forces of a similar volume of working medium, one can write the sum of the forces as $$F_p(z)+F_c(z) = k_p\cdot\left(1+\frac{az}{L}\right)^{-\gamma}+k_c\cdot\left(1+\frac{z}{L}\right)^{-\gamma}. \tag{27}$$

It is obvious that the only condition where this can equal zero, the necessary design feature of the invention, is if $k_p=-k_c$ and a=1 . However, this indicates that in one system increasing the volume decreases the force while in an otherwise identical system it increases the force. This is not possible, so pressure is also mainly a candidate for cam-based implementation.

Figure 5:
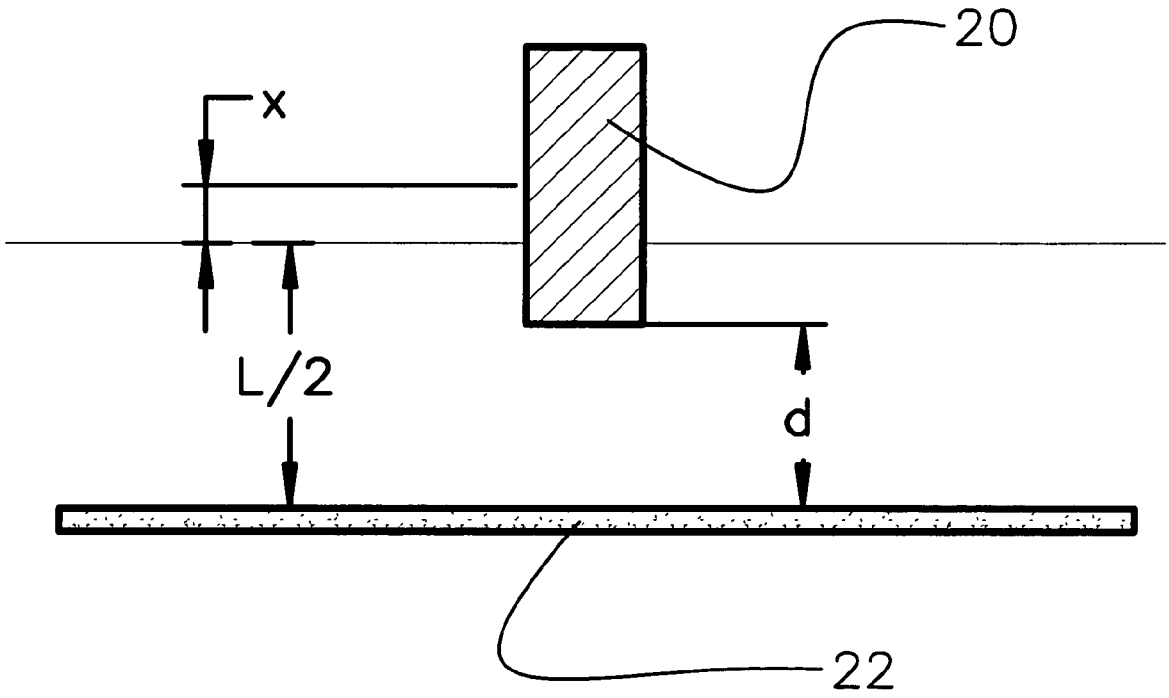
FIG. 5 illustrates a magnetostatic force between a magnet and a ferromagnetic plate.
Figure 6:
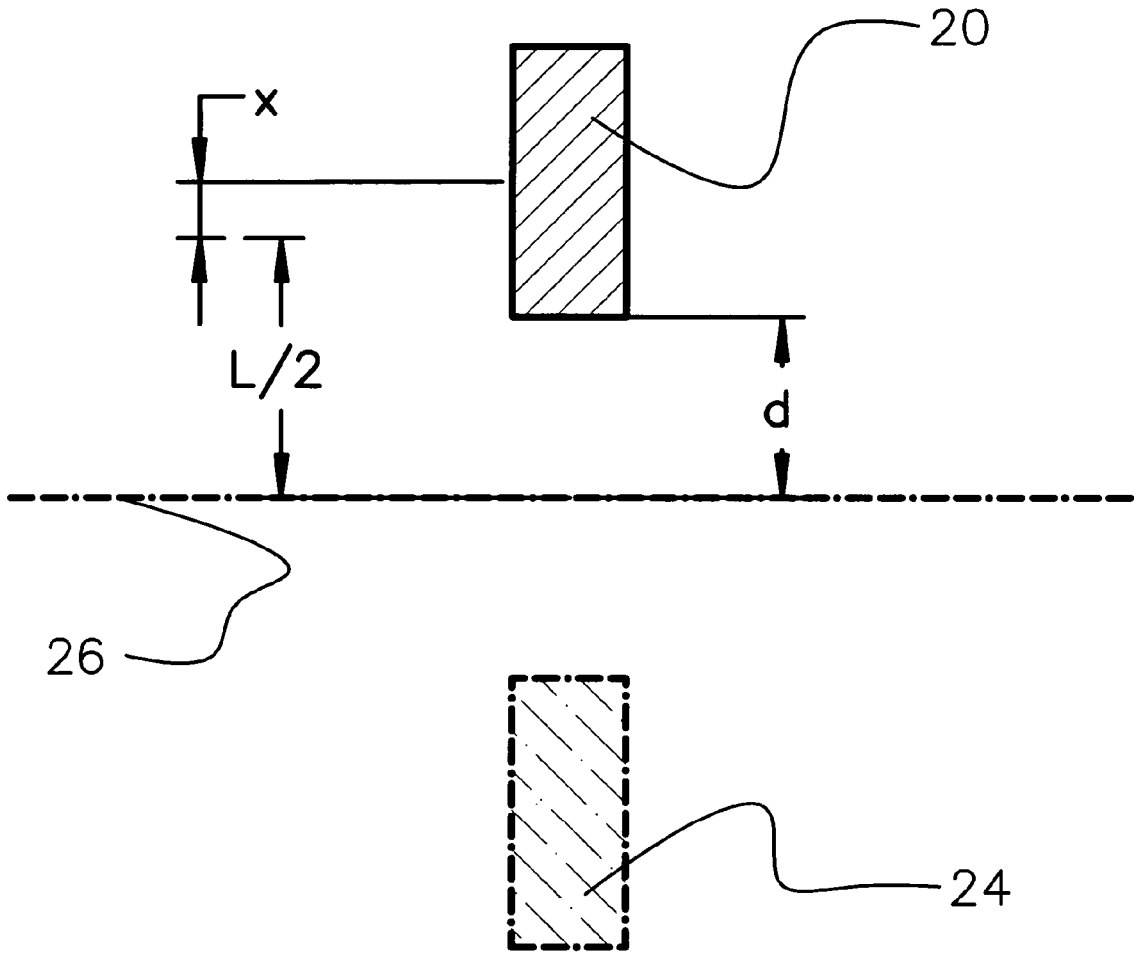
FIG. 6 illustrates the so-called method of images used to analyze the magnetic system of FIG. 5.

In order to assess the suitability of magnetostatic systems to practice the invention, consider the system depicted in cross section in FIG. 5. A permanent cylindrical magnet 20 of magnetization M along its axis, radius $r_m$, and length $l_m$ is suspended a distance d over a ferrous plate, 22. One can view such an arrangement using the "method of images" (see J. D. Jackson, *Classical Electrodynamics*—$2^{nd}$ Ed., John Wiley & Sons, 1975, p. 207), as shown in FIG. 6, where an image 24 of the permanent magnet 20, with equal dimensions and magnetization $$\vec{M}' = M\cdot\frac{(\mu-1)}{(\mu+1)}\hat{z}. \tag{28}$$

is located a distance d below the plane 26 of the ferrous plate 22 (μ is the relative permeability of the plate). The force between the magnet and the plate is, then, identical to the force between the magnet and its image.

A cylindrical magnet with uniform magnetization M directed along its axis can be treated as being induced by a surface current of magnitude M about the circumference of the radial boundary of the magnet (see Jackson, supra). The magnetic field at a point r generated by the image surface current can be determined from the vector potential given by $$\vec{A}(\vec{r}) = \oint_{S'}\frac{(\mu-1)\cdot M\cdot\hat{z}\times\hat{n}}{c\cdot(\mu+1)\cdot|\vec{r}-\vec{r}'|}ds' \tag{29}$$

-continued $$= \frac{(\mu-1)\cdot M\cdot\hat{\varphi}}{c\cdot(\mu+1)}\oint_{S''}\frac{ds''}{|\vec{r}-\vec{r}'|}.$$

where S' is the entire surface of the image magnet and S" is this surface without the z-directed end faces. Solution of Equation 29 using Green's function in cylindrical coordinates yields $$\frac{1}{|\vec{r}-\vec{r}'|} = \sum_{n=-\infty}^{\infty}\int_0^{\infty} dk\cdot e^{i\cdot n(\varphi-\varphi')}\cdot J_n(k\rho)\cdot J_n(k\rho')\cdot e^{-k|z-z'|}. \tag{30}$$

Substituting Equation 30 in Equation 29 gives $$\begin{aligned}\vec{A}(\vec{r}) &= \frac{(\mu-1)\cdot M\cdot\hat{\varphi}}{c\cdot(\mu+1)}\sum_{n=-\infty}^{\infty}\int_0^{\infty} dk\cdot r_m\cdot \\ &\quad J_n(k\rho)\cdot J_n(kr_m)\cdot\int_0^{2\pi} d\varphi'\cdot e^{i\cdot n(\varphi-\varphi')}\cdot \\ &\quad \int_{-d-\frac{l_m}{2}}^{-d+\frac{l_m}{2}} dz'\cdot e^{-k\cdot|z-z'|} \\ &= \frac{(\mu-1)\cdot 2\cdot\pi\cdot r_m\cdot M\cdot\hat{\varphi}}{c\cdot(\mu+1)}\int_0^{\infty}\frac{dk}{k}\cdot J_1(k\rho)\cdot J_1(kr_m)\cdot \\ &\quad \left[e^{-k\left|z+d+\frac{l_m}{2}\right|} - e^{-k\left|z+d-\frac{l_m}{2}\right|}\right].\end{aligned} \tag{31}$$

The standard identification of the magnetic field is given by the curl of the vector potential, which provides $$\begin{aligned}\vec{B}(\vec{r}) &= \nabla\times\vec{A}(\vec{r}) \\ &= \hat{\rho}\frac{\partial A}{\partial z} + \hat{z}\frac{1}{\rho}\frac{\partial}{\partial\rho}(\rho A).\end{aligned} \tag{32}$$

The correspondence between the uniform magnetization and an equivalent surface current reveals that the force on the magnet due to the magnetic field induced by its image is given by $$\begin{aligned}\vec{F}(d) &= c\cdot\oint_S(\vec{M}\times\hat{n})\times\vec{B}\cdot ds \\ &= c\cdot M\oint_S\left(\hat{z}\frac{\partial A}{\partial z} + \hat{\rho}\frac{1}{\rho}\frac{\partial}{\partial\rho}(\rho A)\right)\cdot ds.\end{aligned} \tag{33}$$

By symmetry, the radial-component of the force vanishes, leaving only the z-component:

$$\begin{aligned}F_z(d) &= \frac{(\mu-1)\cdot(2\cdot\pi\cdot r_m\cdot M)^2}{(\mu+1)}\int_0^{\infty}\frac{dk}{k}\cdot J_1^2(kr_m)\cdot\int_{d-\frac{l_m}{2}}^{d+\frac{l_m}{2}} dz \\ &\quad \frac{\partial}{\partial z}\left[e^{-k\left|z+d+\frac{l_m}{2}\right|} - e^{-k\left|z+d-\frac{l_m}{2}\right|}\right]\end{aligned} \tag{34}$$

-continued $$= \frac{-(\mu-1)\cdot(2\cdot\pi\cdot r_m\cdot M)^2}{(\mu+1)}\int_0^{\infty}\frac{dk}{k}\cdot J_1^2(kr_m)\cdot [e^{-k(2d+l_m)} - 2e^{-2kd} + e^{-k(2d-l_m)}].$$

The known solution (see Y. L. Luke, Integrals of Bessel Functions, McGraw-Hill, 1962, pp. 314-318) for the integral in Equation 34 is given by $$\int_0^{\infty}\frac{dk}{k}\cdot J_1^2(ak)\cdot e^{-\lambda k} = \frac{2\left[\frac{\lambda}{2a}\right]\left[E\left[\beta\left(\frac{\lambda}{2a}\right)\right] - K\left[\beta\left(\frac{\lambda}{2a}\right)\right]\right]}{\left[\pi\cdot\beta\left(\frac{\lambda}{2a}\right)\right]} \tag{35}$$

$$\beta(\gamma) = \frac{1}{\sqrt{[1+\gamma^2]}}.$$

where K and E identify the complete elliptic integrals of the first and second kind, respectively. So, the exact solution for the force can now be written as follows, $$\begin{aligned}F_z(d) &= -(2\cdot\pi\cdot r_m\cdot M)^2\sum_{a=-1}^{1}(-2)^{1-|a|}\left(\frac{(\mu-1)}{(\mu+1)}\right)EKB[\kappa_a(d)] \\ EKB[\kappa_a(d)] &= \frac{2[\kappa_a(d)][E[\beta(\kappa_a(d))] - K[\beta(\kappa_a(d))]]}{[\pi\cdot\beta(\kappa_a(d))]} \\ \kappa_a(d) &= \frac{2d + a\cdot l_m}{2r_m}.\end{aligned} \tag{36}$$

Equation 36 provides a rich field of adjustable parameters, making it a candidate for both cam-free and cam-based implementations of the pressure compensation force device of the invention. Conceptual implementations of these two general techniques using the forces examined above are disclosed in the section that follow.

As used herein, the term "reciprocating" is intended to refer to any mechanism that includes a moveable member that undergoes a periodic motion over a repetitive path the extent of which may vary. In the absence of variation of the path the motion of the moveable member is both periodic and cyclical. The term "piston" is used with reference to any moveable member subjected to a reciprocating motion, as defined above.

Countless cam implementations may be employed to counter the pressure force (and the corresponding torque on an engine's output shaft) described above. The following disclosure endeavors to provide details of the procedures required to design suitable candidates.

Figure 7:
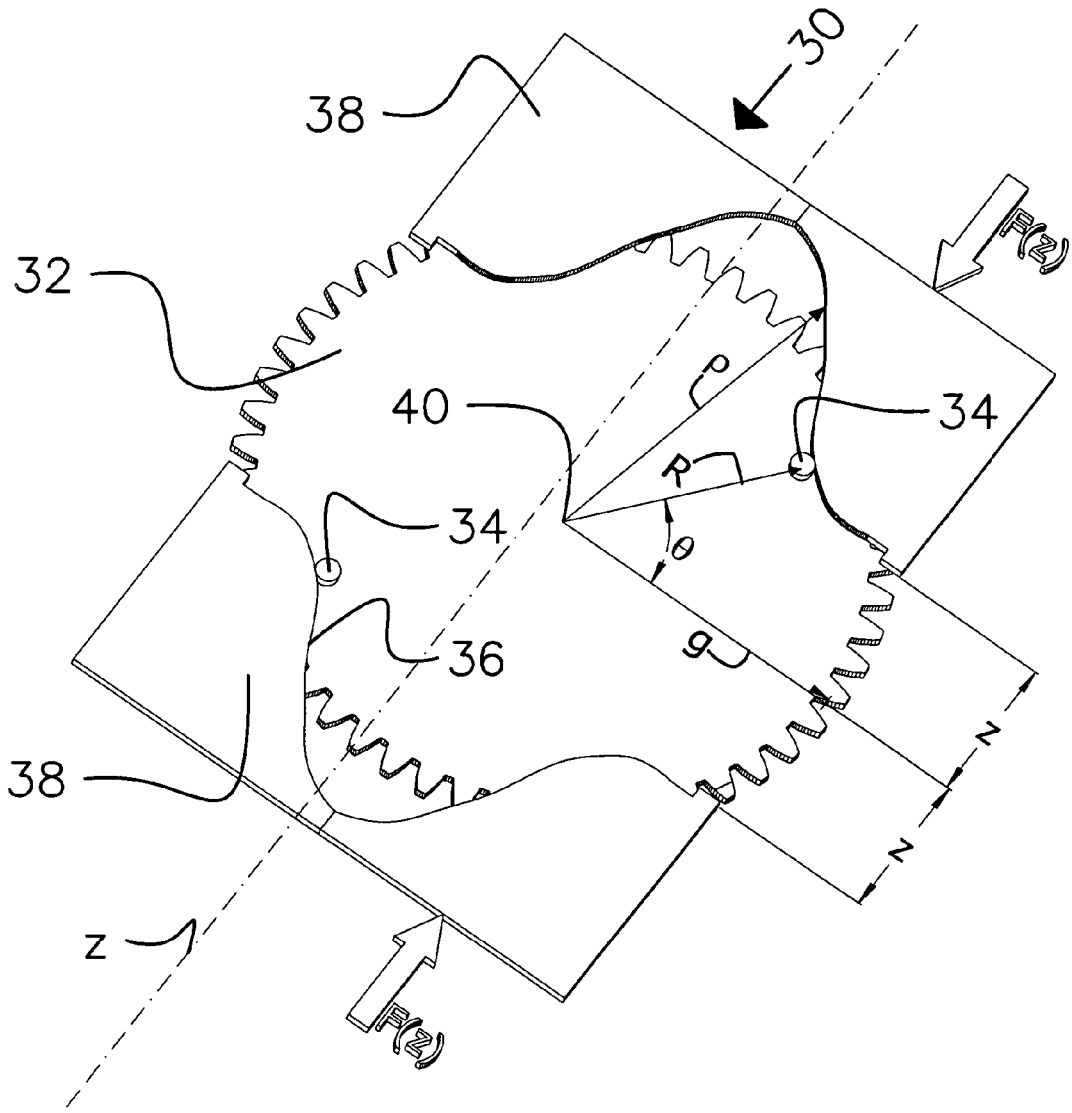
FIG. 7 is a schematic representation of a gear-cam assembly suitable to practice the invention.

With reference to FIG. 7, a gear-cam assembly 30 consists of a gear 32 with two face-mounted, diametrically opposed cam followers 34, such that the followers contact the shaped edges 36 of two symmetric plates 38 as the gear 32 rotates. The plates 38 are restricted to movement along a single axis, labeled z, parallel to the gear face and are subjected to candidate conservative forces, F(z), along that directions shown in the figure (two forces are shown in the figure, but it is understood that a single force, twice the magnitude, could be used in an equivalent manner). As the gear 32 turns about its axis of rotation, the followers 34 serve to displace each plate 38 along its restricted direction of travel. The position of each follower 34 is given by its distance R from the center 40 of the gear 32 and the rotation angle θ of the gear. The working surface of each cam plate 38 is defined by the radius vector p, which is a function of the angle θ. Finally, the radius of the gear is shown as g.

Figure 8:
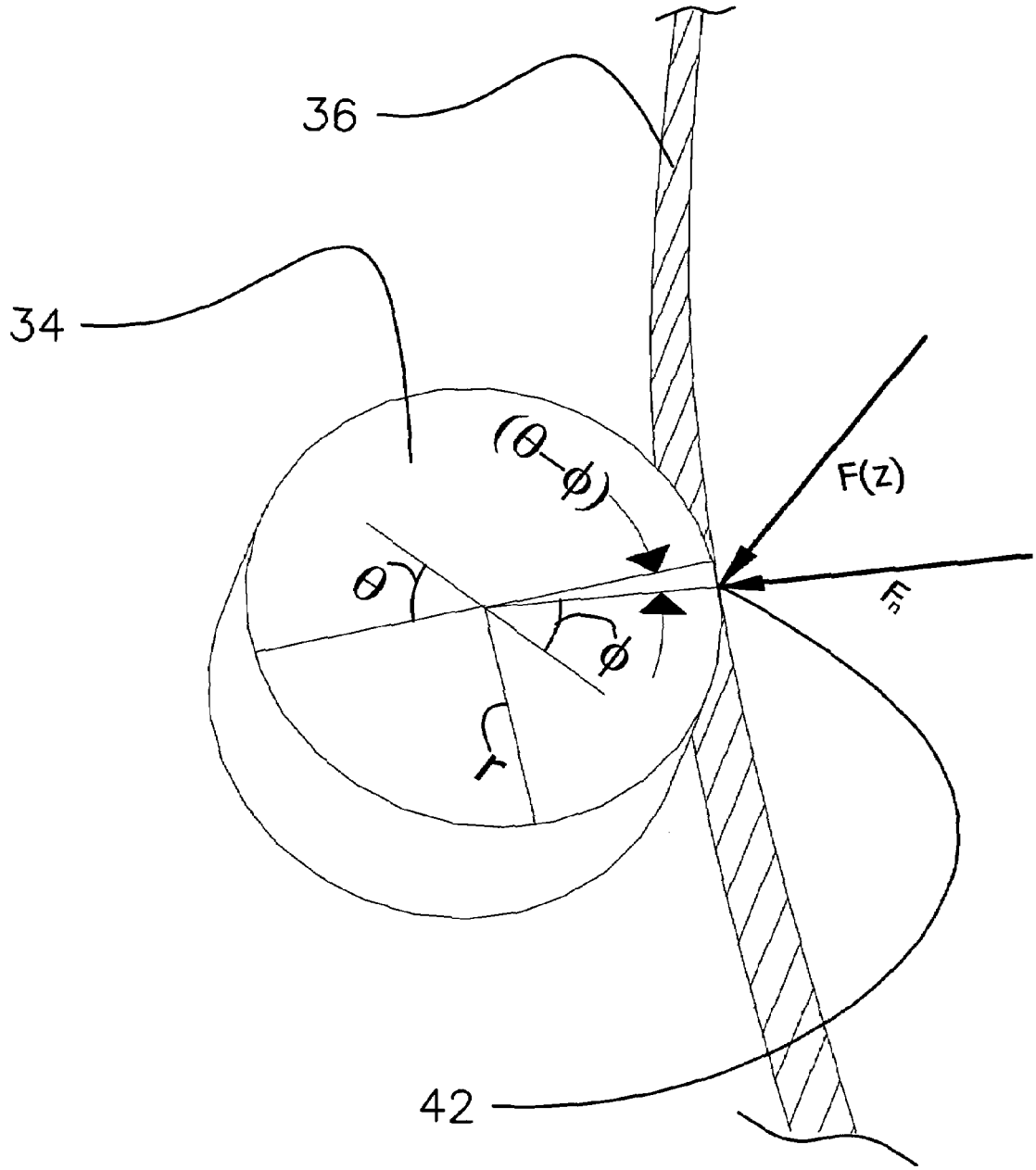
FIG. 8 illustrates the geometry of the cam follower's contact with the cam plate in the assembly of FIG. 7.

FIG. 8 provides a detailed view of the cam-follower/cam-plate contact geometry highlighting the difference between the contact angle, ϕ, and the follower position angle, θ. This detailed view identifies the radius vector as $$\vec{\rho}=(R\cos(\theta)+r\cos(\phi))\hat{x}+(R\sin(\theta)+r\sin(\phi)-z)\hat{y}, \tag{37}$$

which is the defining equation for the shape of the cam. The candidate counterforce, F(z), is applied to the gear 20 only through its normal component $F_n$ at the cam/follower contact point 42. This normal force $F_n$ is also seen in FIG. 8.

Figure 9:
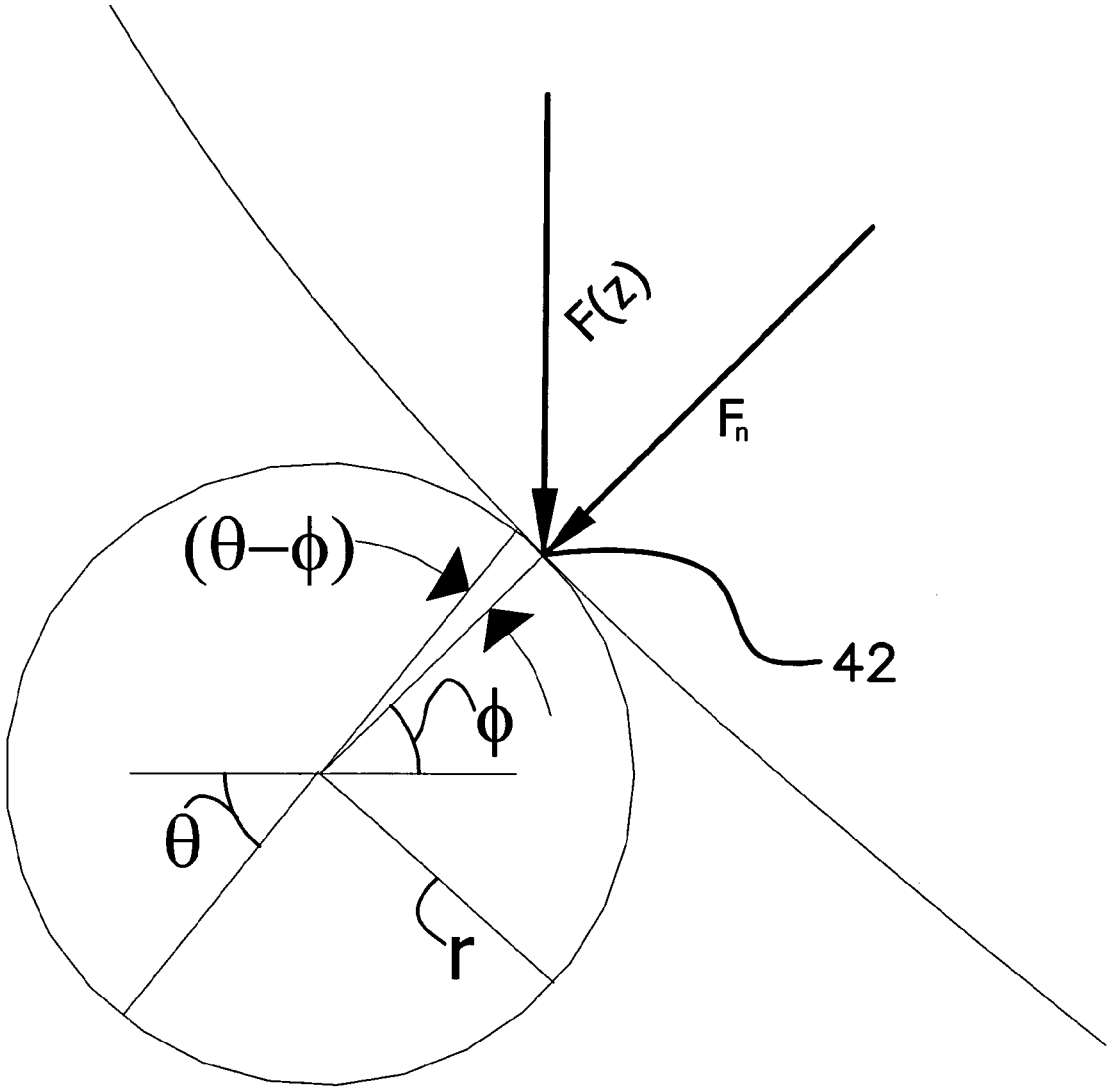
FIG. 9 illustrates the forces resulting from the geometry shown in FIG. 8.

The geometry shown in FIGS. 7-9 leads to the derivation $$\begin{aligned} F_n(z) &= F(z)\cdot\cos\left(\frac{\pi}{2}-\varphi\right) \\ &= F(z)\cdot\sin(\varphi) \\ F_t(z) &= F_n(z)\cdot\sin(\theta-\varphi) \\ &= F(z)\cdot\sin(\varphi)\cdot\sin(\theta-\varphi) \\ \tau_c(z) &= R\cdot F_t(z) \\ &= R\cdot F(z)\cdot\sin(\varphi)\cdot\sin(\theta-\varphi) \end{aligned} \tag{38}$$

where $F_t(z)$ identifies the force perpendicular to R that results in a torque, $\tau_c$, about the gear's axis of rotation. The force that is to be countered, $F_0$, will be applied to the gear teeth resulting in an additional torque $$\tau_0=g\cdot F_0(g\theta). \tag{39}$$

In order to achieve the condition whereby the force $F_0$ is negated, $\tau_0=-\tau_c$.

In general, $F_0$ will be a function of the rotation angle of the gear, θ, as shown. This results in the relationship $$g\cdot F_0(\theta)+R\cdot F(z)\cdot\sin(\phi)\cdot\sin(\theta-\phi)=0. \tag{40}$$

Not only must the torques cancel at all points of operation but so, too, must the energy changes. Therefore, the following identity must exist, $$g\int_{\theta_i}^{\theta_f} F_0(\theta)\,d\theta=\int_{z_i}^{z_f} F(z)\,dz, \tag{41}$$

which, when combined with Equation 40, provides the relationships necessary to identify the constituents of Equation 37 and, thereby, the required shape of the cam.

Figure 10:
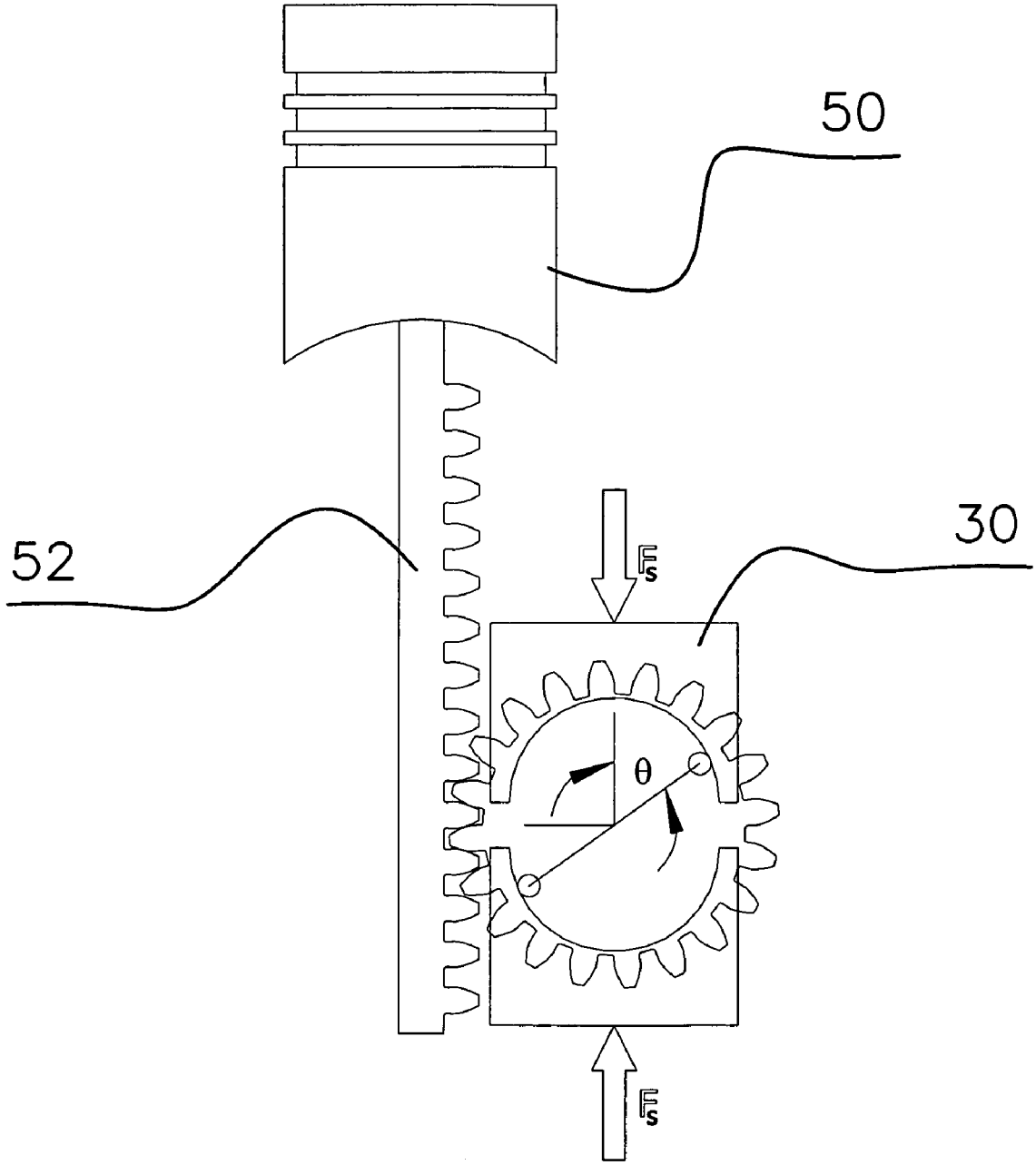
FIG. 10 illustrates the invention coupling the gear-cam assembly of FIG. 7 with a linear piston.

With reference to FIG. 10, a piston 50 fitted to a rack 52 (a linear gear) oscillates within a cylinder (not shown) subject to the counterforces of a gear-cam assembly 30, as described above. It is assumed that the maximum volume of the cylinder is given by $$V_0=AL, \tag{2}$$

where A is the cross-sectional area of the piston/cylinder and L is the characteristic cylinder length. The instantaneous volume of the cylinder is given by $$V=A(L-g\cdot\theta). \tag{3}$$

Assuming atmospheric pressure in the cylinder at θ=0, Equation 3 yields $$F_p(\theta)=P_A A\left[\left(1-\frac{g}{L}\cdot\theta\right)^{-\gamma}-1\right] \tag{44}$$

For demonstration purposes, consider the use of a common spring as the counterforce providing $$F_c(z)=-k\cdot z. \tag{5}$$

Inserting Equations 44 and 45 into Equation 41 results in $$\begin{aligned} g\int_0^{\theta} F_p(\theta')\,d\theta' &= \int_{z_0}^{z} F_c(z')\,dz' \\ \frac{P_A AL}{\gamma-1}\left[\left(1-\frac{g}{L}\cdot\theta\right)^{1-\gamma}-1-\frac{g}{L}(\gamma-1)\theta\right] &= -\frac{1}{2}k(z^2-z_0^2). \\ z(\theta) &= \left[z_0^2-\frac{2P_A AL}{k(\gamma-1)}\left[\left(1-\frac{g}{L}\cdot\theta\right)^{1-\gamma}-1-\frac{g}{L}(\gamma-1)\theta\right]\right]^{\frac{1}{2}} \end{aligned} \tag{46}$$

It is then possible to use Equations 44, 45 and 46 in Equation 40 to find the critical relationship between ϕ and θ. In this process care must be taken to use values of the spring constant, k, and its initial deformation, $z_0$, corresponding to θ=0 such that the resulting cam shape definition is smooth and continuous. It may also be necessary to limit the extent of rotation, $\theta_{max}$, in order to find a suitable solution.

Figure 11:
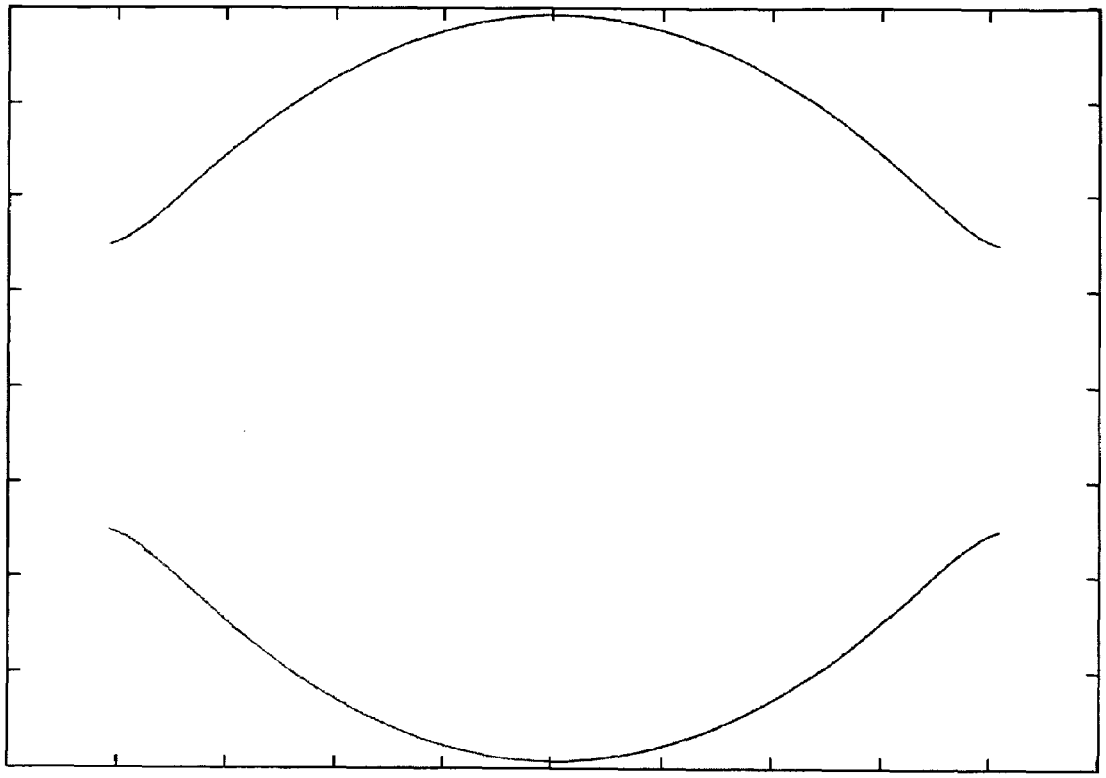
FIG. 11 shows the shape of the cam required to counter the conservative force acting on the piston in the arrangement of FIG. 10.
Figure 12:
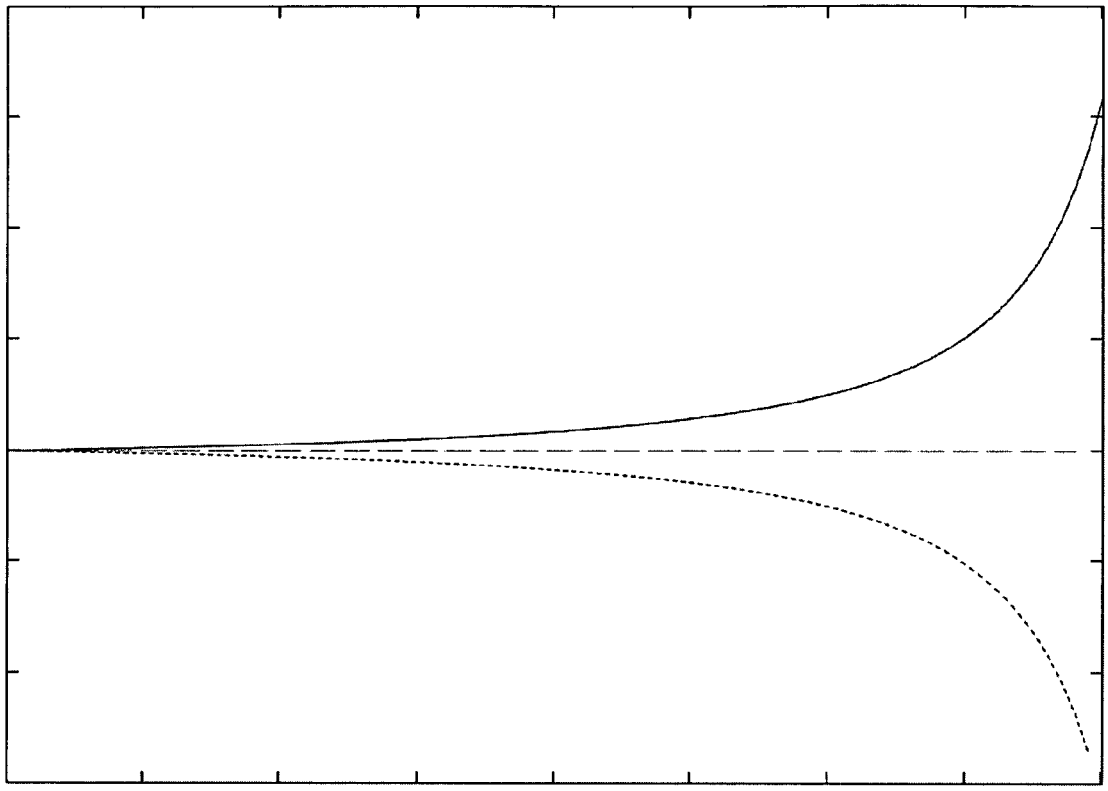
FIG. 12 shows the result produced by the cam of FIG. 11 in the arrangement of FIG. 10.

As an example, the configuration shown in FIG. 10 with the parameters listed in Table 1 below results in the cam shape shown in FIG. 11. FIG. 12 shows the performance of such a cam.

TABLE 1

| Linear Gear-Cam Example Parameters | |
|---|---|
| $\frac{g}{L}$ | 1.125 |
| $\frac{z_0}{L}$ | 0.6 |
| $\frac{r_p}{L}$ | 0.3 |
| $\frac{k}{L\cdot P_A}$ | 15.3 |

In the plot of FIG. 12, the horizontal axis is the rotational angle and the vertical axis is the torque on the gear cam. The solid line is the torque due to the pressure force, the dotted line indicates the torque due to the spring, and the dashed line shows the resulting sum. The vanishingly small net torque shows that the goal of countering the pressure force has been achieved.

Figure 13:
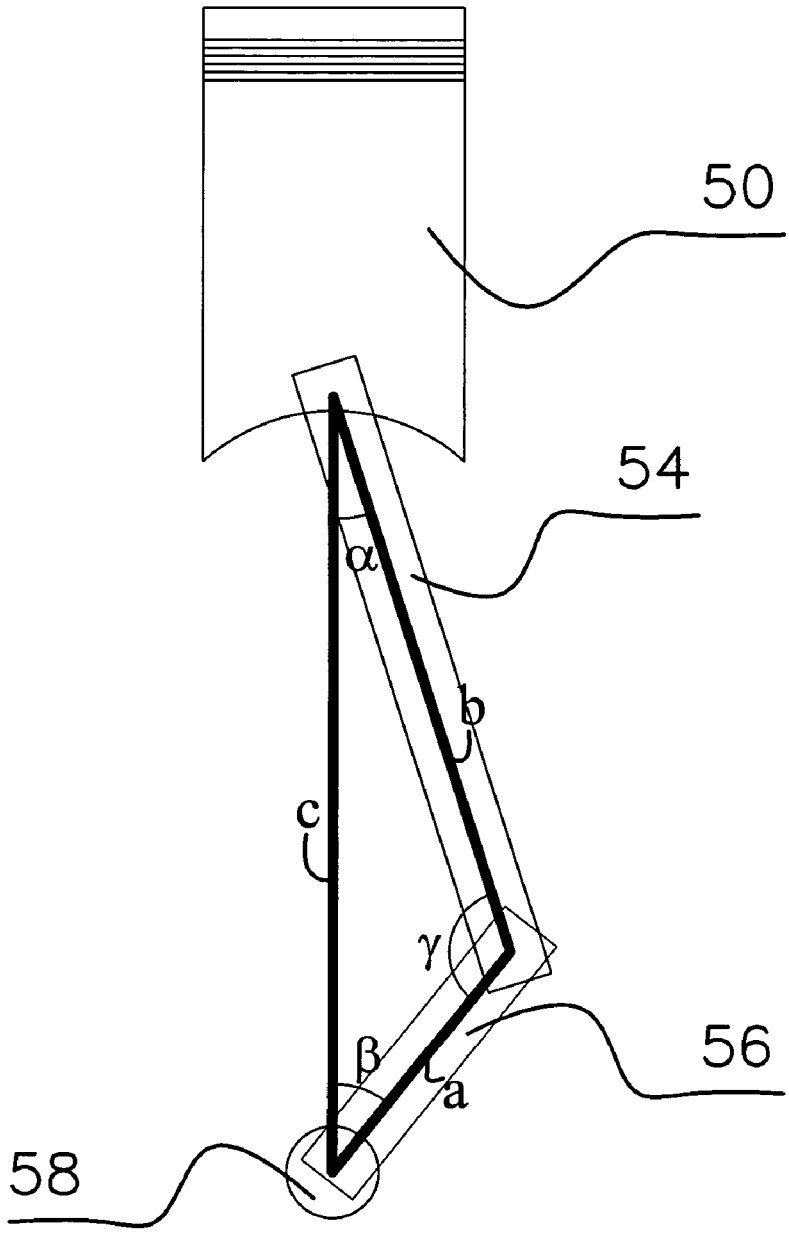
FIG. 13 shows the geometry of a typical piston/crankshaft arrangement.

FIG. 13 illustrates compensation according to the invention in a system comprising a conventional reciprocating piston 50 and a connecting rod 54 hingedly attached to the piston and to the crank 56 of a rotating crankshaft 58. The triangle formed by these elements is represented in the figure by side lengths a, b, and c and angles α, β, and γ. Recalling various trigonometric identities, it is possible to derive the following relations:

$$c = a\cdot\cos(\beta) + b\cdot\cos(\alpha) \tag{47}$$

$$\frac{a}{\sin(\alpha)} = \frac{b}{\sin(\beta)} \Rightarrow \cos(\alpha) = \left[1 - \left(\frac{a}{b}\right)^2 \sin^2(\beta)\right]^{\frac{1}{2}}.$$

$$c = a\cdot\cos(\beta) + [b^2 - a^2\sin^2(\beta)]^{\frac{1}{2}}$$

Assuming a total cylinder length L leads to the following additional relations:

$$V = A\cdot(L-c) = A\cdot\left(L - a\cdot\cos(\beta) - [b^2 - a^2\sin^2(\beta)]^{\frac{1}{2}}\right), \tag{48}$$

$$V_0 = A\cdot(L+a-b)$$

where the reference volume is identified as that at bottom dead center (BDC), when $\beta=\pi$. This choice is made to correspond with the closing of the cylinder intake valve at the end of the intake stroke.

On the basis of the well-known adiabatic compression/expansion relation (see F. Reif, *Fundamentals of Statistical and Thermal Physics,* McGraw-Hill, New York, 1965, p. 159)

$$pV^{\gamma}=c, \tag{49}$$

wherein $\gamma$ is normally assumed to be the ratio of constant-pressure to constant volume heat capacities and c represents that the quantity is constant over the volumetric range, the pressure can be written as $$p_a(V) = p_0\left(\frac{V_0}{V}\right)^{\gamma}, \tag{50}$$

where the zero subscript identifies some reference volume, temperature, and pressure. Inserting the items of Equation 48 into Equation 50 leads to the following adiabatic relation:

$$F(\beta) = p(\beta)\cdot A \tag{51}$$

$$= p_0 A\cdot\left(\frac{L - a\cdot\cos(\beta) - [b^2 - a^2\sin^2(\beta)]^{\frac{1}{2}}}{(L+a-b)}\right)^{-\gamma}.$$

It is noted that the isothermal version of Equation 51 may be obtained by setting $\gamma=1$.

The torque about the axis of the crankshaft 58 is given by the product of the component of the force of Equation 51 along the connecting rod 54 and the perpendicular distance from this force component and the crankshaft axis. This is given by $$\tau(\beta) = \frac{F(\beta)}{\cos(\alpha)}\cdot c\cdot\sin(\alpha) = \tag{52}$$

$$\frac{p_0 A}{\left[1 - \left(\frac{a}{b}\right)^2\sin^2(\beta)\right]^{\frac{1}{2}}}\cdot\left(\frac{L - a\cdot\cos(\beta) - [b^2 - a^2\sin^2(\beta)]^{\frac{1}{2}}}{(L+a-b)}\right)^{-\gamma}.$$

-continued $$\left(a\cdot\cos(\beta) + [b^2 - a^2\sin^2(\beta)]^{\frac{1}{2}}\right)\cdot\left(\frac{a}{b}\right)\sin(\beta) =$$

$$p_0 A a\cdot\sin(\beta)\cdot\left(\frac{L - a\cdot\cos(\beta) - [b^2 - a^2\sin^2(\beta)]^{\frac{1}{2}}}{(L+a-b)}\right)^{-\gamma}.$$

$$\left(a\cdot\cos(\beta)\cdot[b^2 - a^2\sin^2(\beta)]^{\frac{1}{2}} + 1\right).$$

Finally, the compression ratio and its relationship to L may be identified by the relations $$r_c = \frac{(L+a-b)}{(L-a-b)}. \tag{53}$$

$$L = b + \frac{r_c+1}{r_c-1}\cdot a$$

Figure 14:
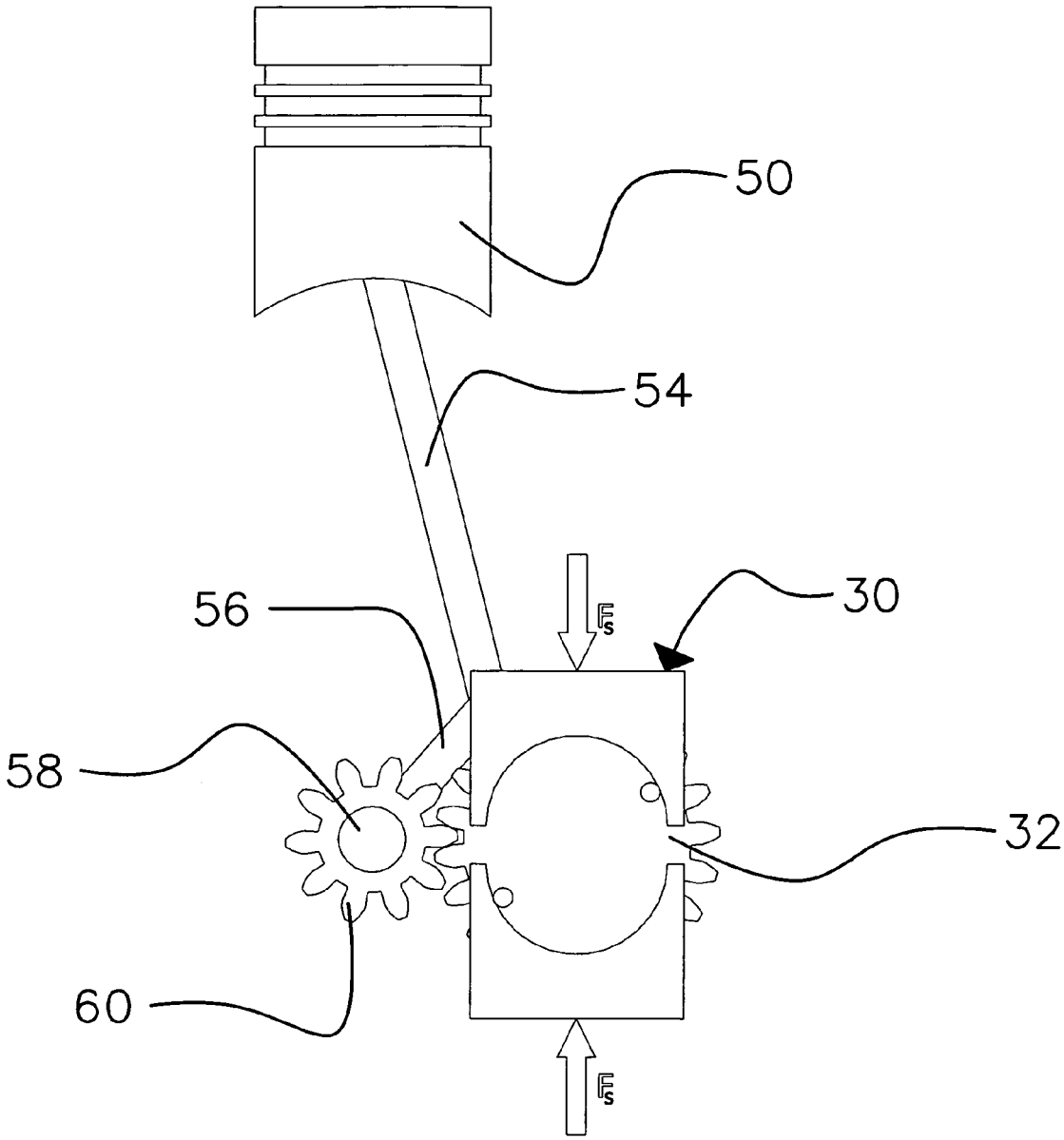
FIG. 14 illustrates the invention coupling the gear-cam assembly of FIG. 7 with the rotational piston arrangement of FIG. 13.

It is clear that one stroke of the piston 50 in this system equates to $2\pi$ radians of rotation of the crankshaft 58. Examination of the gear cam mechanism of FIG. 7 shows that one "stroke" of the counterforce F(z) occurs in $\pi$ radians of the gear rotation. Therefore, the gear-cam mechanism, as described above, must rotate at half the rate of the crankshaft 58 in order to be properly synchronized with it. This is accomplished using a gear-cam gear 32 twice the radius of the mating gear 60 coupled to the crankshaft 58, as shown in FIG. 14.

The size/ratio difference in the gears 32, 60 results in a pressure-sourced torque on the gear-cam gear 32 given by $$\tau_p(\theta) = 2p_0 A a\cdot\sin(2\theta)\cdot\left(\frac{L - a\cdot\cos(2\theta) - [b^2 - a^2\sin^2(2\theta)]^{\frac{1}{2}}}{(L+a-b)}\right)^{-\gamma}. \tag{54}$$

$$\left(a\cdot\cos(2\theta)\cdot[b^2 - a^2\sin^2(2\theta)]^{-\frac{1}{2}} + 1\right).$$

If a spring is again used as the example counterforce of the invention, then Equation 45 remains valid. Accordingly, the solution previously used in the linear piston example provides again a reliable template for determining the cam shape in the rotational case.

Thus, a function for z in terms of $\theta$ is found as follows:

$$z(\theta) = \left[z_0^2 - \frac{2}{k}\int_0^{\theta}\tau_p(\theta')\,d\theta'\right]^{\frac{1}{2}}, \tag{55}$$

Then, the resulting torque-balance Equation 40 is solved for $\phi(\theta)$, which yields $$\sin(\varphi)\cdot\sin(\theta-\varphi) = \frac{\tau_p(\theta)}{R\cdot k\cdot\left[z_0^2 - \frac{2}{k}\int_0^{\theta}\tau_p(\theta')\,d\theta'\right]^{\frac{1}{2}}}, \tag{56}$$

The results are then substituted into Equation 37 to determine the necessary cam shape.

Figure 15:
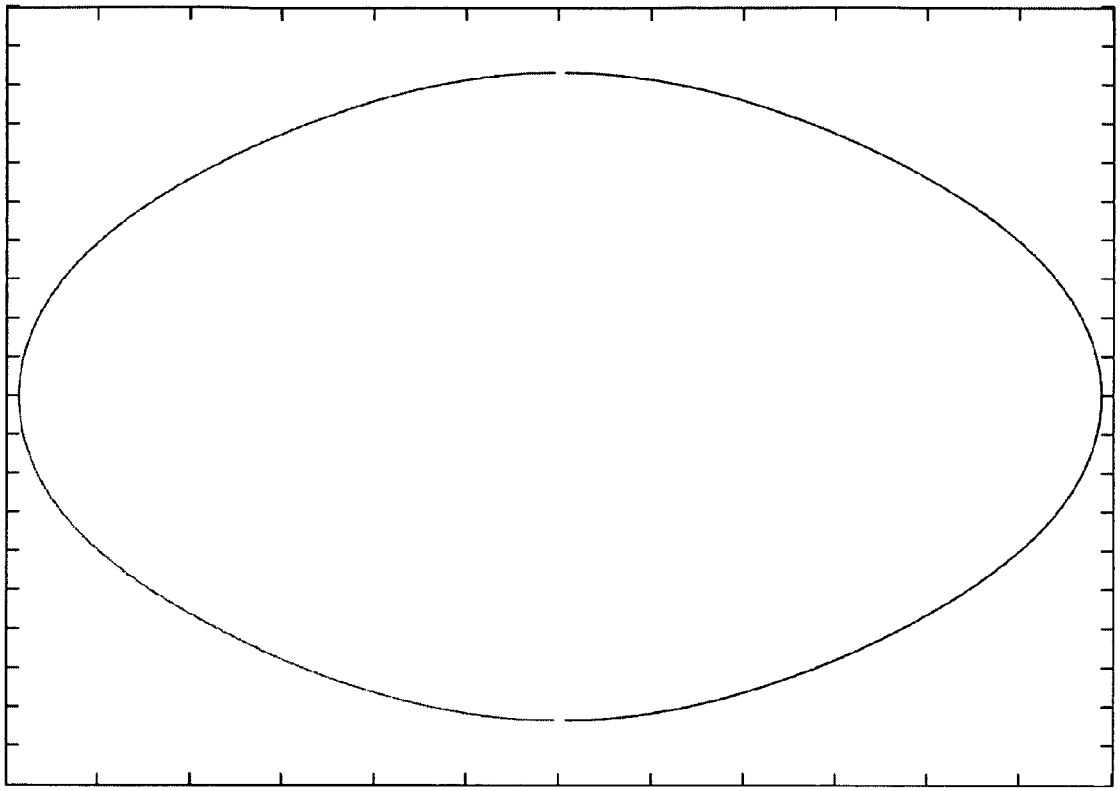
FIG. 15 shows the shape of the cam required to counter the conservative force acting on the piston in the arrangement of FIG. 14.
Figure 16:
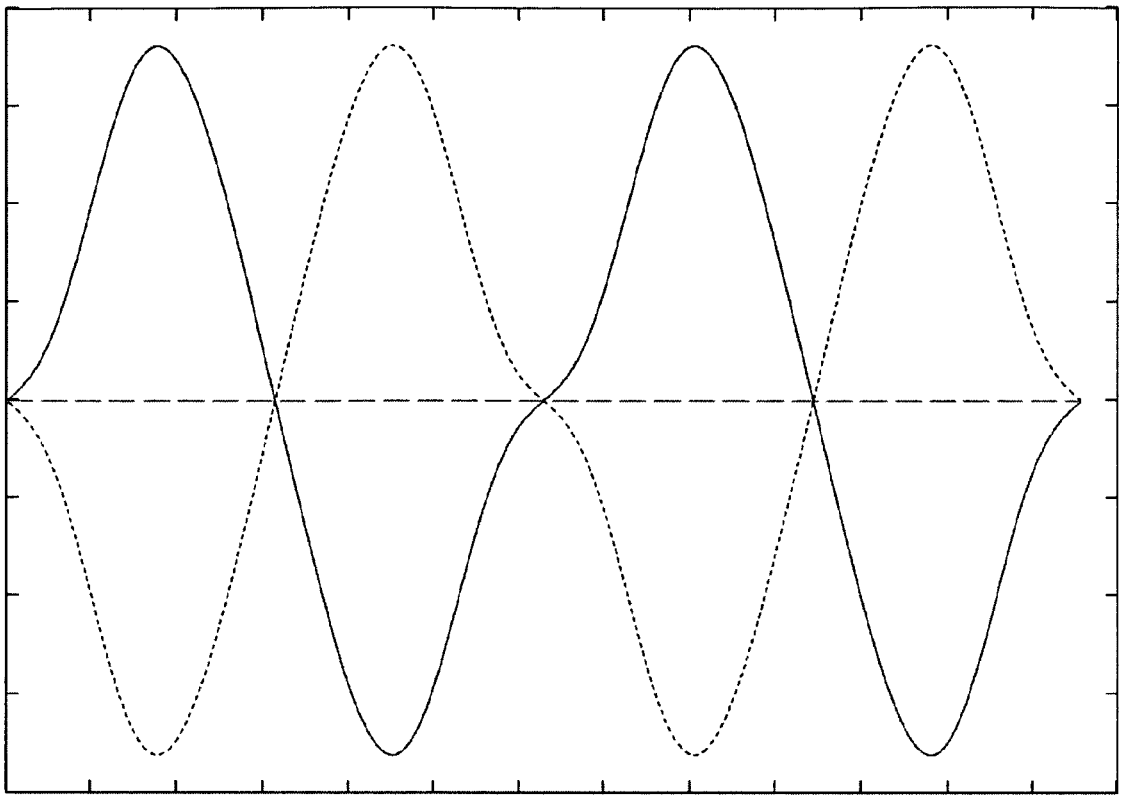
FIG. 16 shows the result produced by the cam of FIG. 15 in the arrangement of FIG. 14.

An example of this exercise is shown in Table 2 below and in FIGS. 15 (showing the cam shape) and 16 (showing the corresponding gear-cam performance. Again, the performance plot of FIG. 16, which ranges over a full rotation of the gear cam, indicates that the goal of countering the pressure forces has been met.

TABLE 2

| Rotational Gear Cam Results | |
|---|---|
| $r_c$ | 10 |
| $\frac{g}{L}$ | 0.573 |
| $\frac{z_0}{L}$ | 0.2 |
| $\frac{r_p}{L}$ | 0.3 |
| $\frac{k}{L \cdot P_A}$ | 3.671 |

As is well understood in the art of internal combustion engines, two main operating modes are mostly employed in practice. They are normally referred to as the two-cycle and the four-cycle modes. The former allows for the intake of the fuel/air mixture and the exhaust of combustion products during the power stroke. The latter requires two full translations of the piston for each cycle. Accordingly, pressure compensation of the two-cycle engine may be accomplished as shown in the examples above, since those examples employ a $2\pi$ cycle protocol. However, compensating a four-stroke engine requires a minor modification whereby the cam plate is held fixed at its $\theta=0$ position during every other full translation of the piston.

Figure 17:
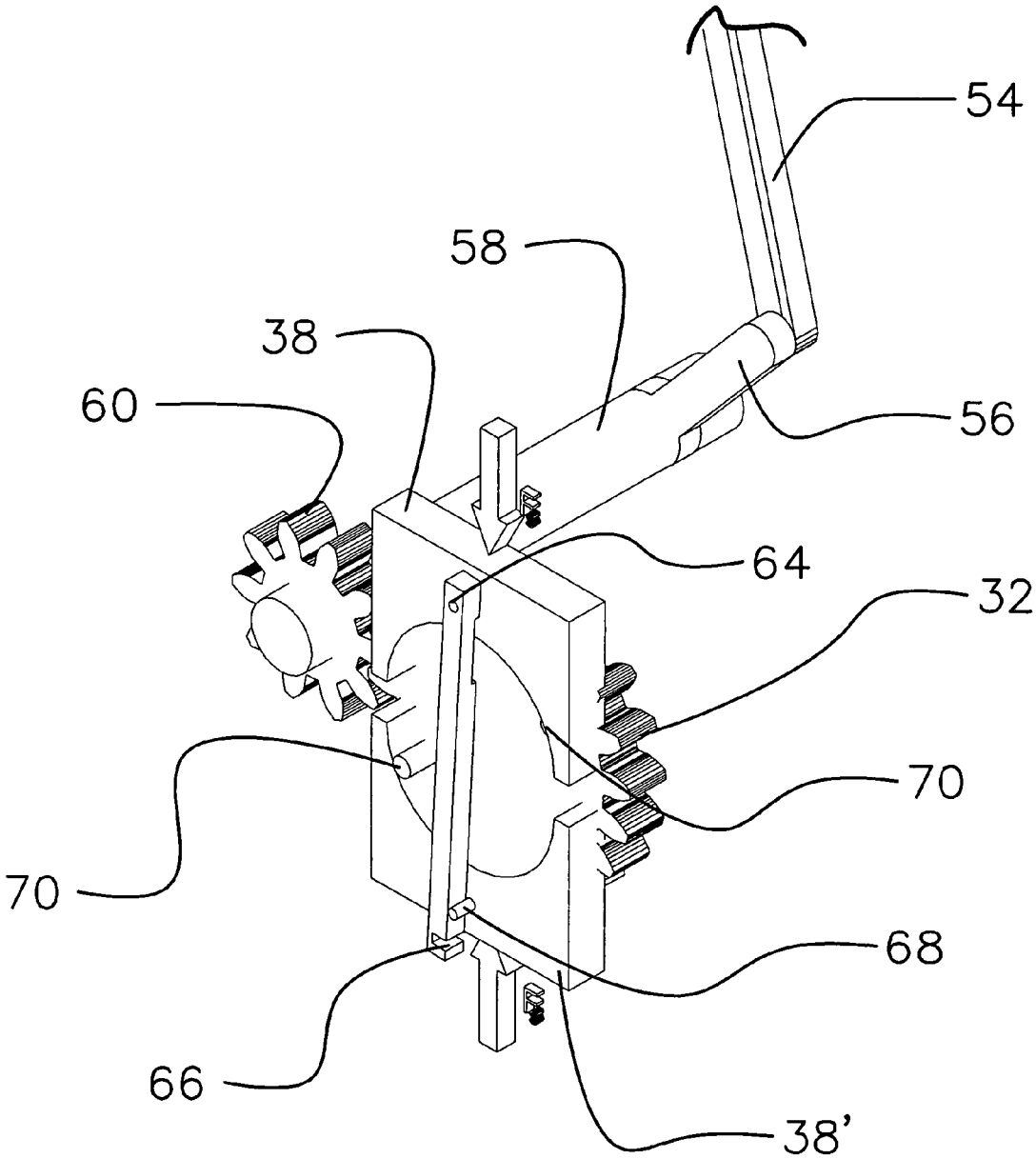
FIG. 17 illustrates the invention coupling-the gear-cam assembly of FIG. 7 with a four-stroke engine.

A possible, although obviously not exclusive, example of such a modification is shown in FIG. 17. A bar 62 is hingedly coupled to a fixed mounting point 64 on the upper cam plate 38 and includes a notch 66 adapted to capture a post 68 on the lower cam plate 38' when the separation distance between the two cam plates is maximum, thereby removing the counterforce from the system. One of the cam followers 70 is longer than the other (shown as 70'), so that it will contact the lower portion of the bar 62 over a small arc as the follower 70 passes through during the rotation of the gear-cam gear 32. This frees the cam plates 38,38' and reintroduces the counterforce to the system. Since only one of the two followers can free the cam plates, the counterforce will only be applied over $\pi$ radians or, by the analysis above, over every other stroke of the piston. Thus, during the compression and power strokes of the four-cycle engine, the counterforce is active; during the exhaust and intake strokes, it is absent.

The discussion above deals exclusively with single-piston engines, but it is clear that the concept is applicable and can readily be extended to multiple-piston engines as well. In such devices, some phase difference is typically introduced among the various piston positions. Therefore, the conservative pressures in each cylinder may still be countered with a single compensation device (e.g., a gear cam), but proper adjustment must be provided for each compensator to match the phase of its piston. In the rotational (i.e., crankshaft) scheme, all compensation devices may be assembled into a single unit that may then be mated to the crankshaft.

As mentioned above, the goal of optimizing the efficiency of a system in which a substance is cyclically compressed may be achieved using any static device capable of conservative-force implementation. Among the various static forces described above (gravity, spring, electrostatic, magnetostatic, pressure), the only ones that would not normally make use of special coupling apparatus are the magnetostatic and, marginally, electrostatic forces. Since magnets are necessarily dipole devices, they lend themselves more readily to applications in which both poles are used. This implies a C2 symmetry of the resulting counterforce mechanism, which, in turn, implies a corresponding symmetry in the heat engine of interest.

Building on the magnetostatic development presented above, it is useful to identify the location of the center of the magnet 20 (see FIG. 5) with respect to some point a distance L/2 above the plate 22. Labeling this coordinate as x, one can write $$F_{gs}(x) = -(2\cdot\pi\cdot r_m\cdot M)^2\sum_{a=-1}^{1}(-2)^{1-|a|}\left(\frac{(\mu-1)}{(\mu+1)}\right)EKB[\gamma_a(x)] \tag{57}$$

$$EKB[\gamma_a(x)] = \frac{2[\gamma_a(x)][E[\beta(\gamma_a(x))] - K[\beta(\gamma_a(x))]]}{[\pi\cdot\beta(\gamma_a(x))]}$$

$$\gamma_a(x) = \frac{L + a\cdot l_m + 2\cdot x}{2\cdot r_m},$$

where the subscript gs denotes a general, single-plate configuration.

Figure 18:
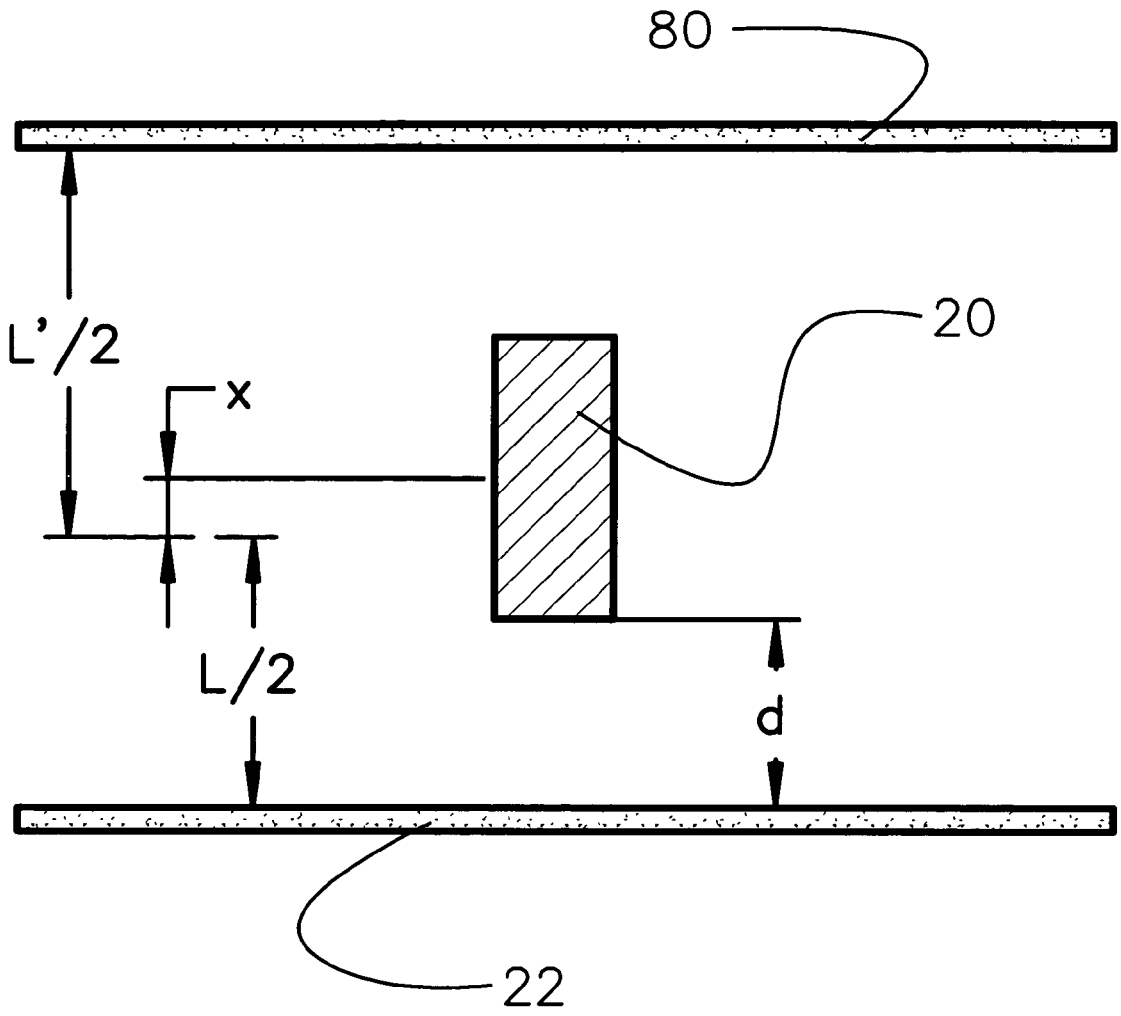
FIG. 18 illustrates a magnetostatic application of the invention based on a cylindrical magnet suspended between two fixed plates that define a cavity therebetween.

It is now relatively trivial to extend the solution for the system illustrated in FIG. 18. In this configuration, the cylindrical magnet 20 is suspended between two fixed plates 22 and 80 that define a cavity therebetween. Plate 22, with relative permeability $\mu_2$, lies a distance L/2 below the magnet center, as before. Plate 80, with relative permeability $\mu_5$, sits a generally different distance L'/2 above the magnet center. The force on the magnet 20, as a function of the magnet's change of its center position, x, can be immediately written as $$F_{gd}(x) = (2\cdot\pi\cdot r_m\cdot M)^2 \tag{58}$$

$$\sum_{a=-1}^{1}(-2)^{1-|a|}\left[\left(\frac{(\mu_5-1)}{(\mu_5+1)}\right)EKB[\gamma'_a(-x)] - \left(\frac{(\mu_2-1)}{(\mu_2+1)}\right)EKB[\gamma_a(x)]\right],$$

$$\gamma'_a(x) = \frac{L' + a\cdot l_m + 2\cdot x}{2\cdot r_m}$$

where the subscript gd indicates a general, dual-plate system.

It is readily apparent from this equation that, if the permeabilities of the two plates 22, 80 are identical, then, by symmetry, the point of reference defined by L and L' is such that L'=L and the following results:

$$F_d(z) = \tag{59}$$

$$(2\cdot\pi\cdot r_m\cdot M)^2\left(\frac{(\mu-1)}{(\mu+1)}\right)\sum_{a=-1}^{1}(-2)^{1-|a|}[EKB[\gamma_a(-z)] - EKB[\gamma_a(z)]].$$

The subscript on F is changed to simply d in order to denote the particular symmetric configuration.

Figure 19:
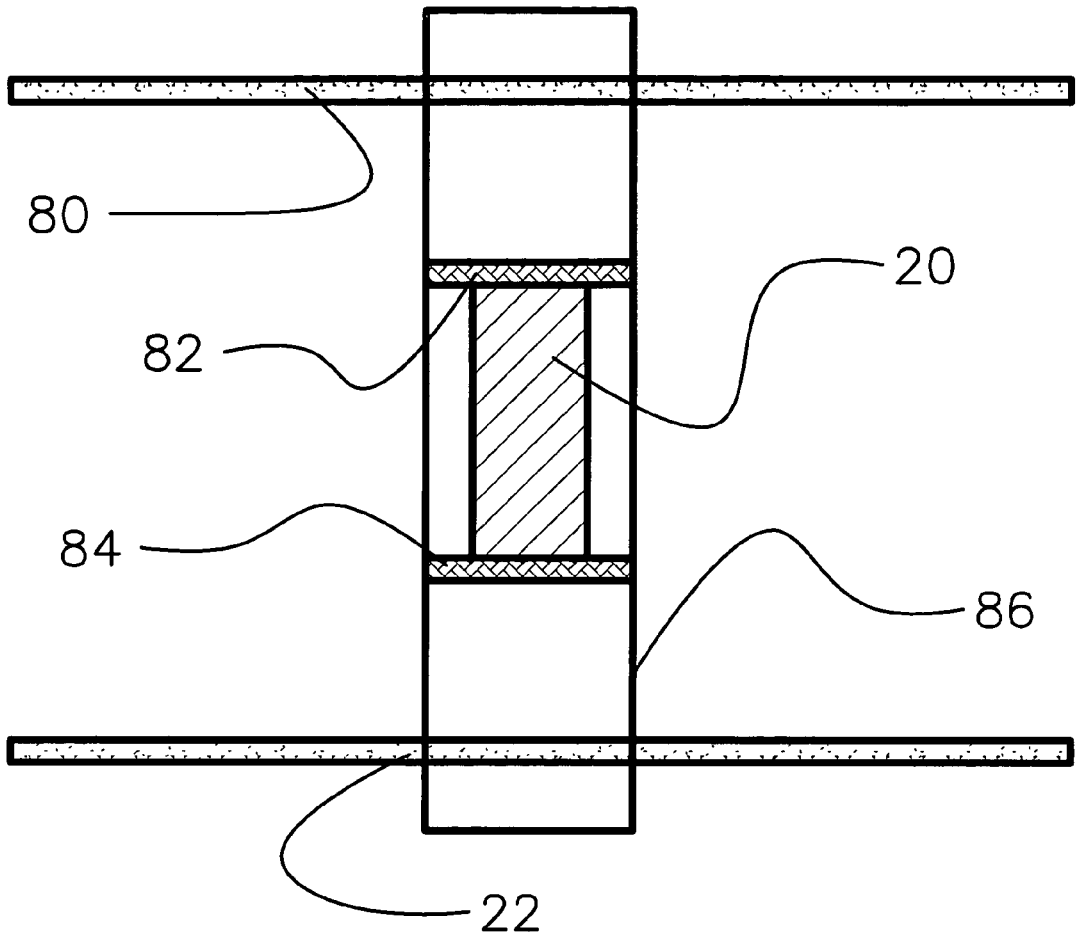
FIG. 19 shows a symmetric system wherein a magnet is fitted with two end caps and is constrained to motion in a sealed gas-filled cylinder.

Referring to FIG. 19, the magnet 20 of a symmetric system is fitted with two end caps, 82 and 84, and constrained to motion in a sealed gas-filled cylinder 86 of length $\Delta$. We assume here that the end caps 82,84 form a pneumatic seal with the cylinder walls and the ferrous plates provide a small hole through which the gas can pass. As this magnetic piston is displaced toward one end of the cylinder, the pressure will rise in that end and fall in the other, resulting in a restoring pressure-force on the piston. At the same time, the piston will be attracted toward the plate in the direction of travel according to Equation 59.

The pressure force on the piston, assuming sufficient thermal insulation or rapid enough operation to legitimize an adiabatic system model, can be shown to be given by the equation $$\begin{aligned} p_a(x)A &= p_0A\left(1+\frac{x}{L_0}\right)^{-\gamma} - p_0A \\ &\equiv F_a(x) \\ &= p_0A\left[\left(1+\frac{x}{L_0}\right)^{-\gamma} - 1\right]. \\ &= F_0\left[\left(1+\frac{x}{L_0}\right)^{-\gamma} - 1\right] \end{aligned} \tag{60}$$

which leads to $$F_P(x) = \pi \cdot r_P^2 \cdot P_A \cdot \left[\left(1+\frac{2x}{\Delta}\right)^{-\gamma} - \left(1-\frac{2x}{\Delta}\right)^{-\gamma}\right]. \tag{61}$$

The goal, as closely as possible, is to oppose the pressure force on the piston as identified by Equation 61 with the magnetic forces given by Equation 59. To do so, a general numerical optimization procedure is performed to find the appropriate values of the various parameters of the system. The results of such an optimization are shown in Table 3 below and in FIG. 20.

TABLE 3

| Cam-Free Adiabatic Compensation Result | |
|---|---|
| Parameter | Value |
| $\frac{P_A \cdot (\mu+1)}{4 \cdot \pi \bullet M^2 (\mu - 1)}$ | 0.097 |
| $\frac{l_m}{L}$ | 0.368 |
| $\frac{r_m}{L}$ | 0.184 |
| $\frac{\Delta}{L}$ | 1.124 |

Figure 20:
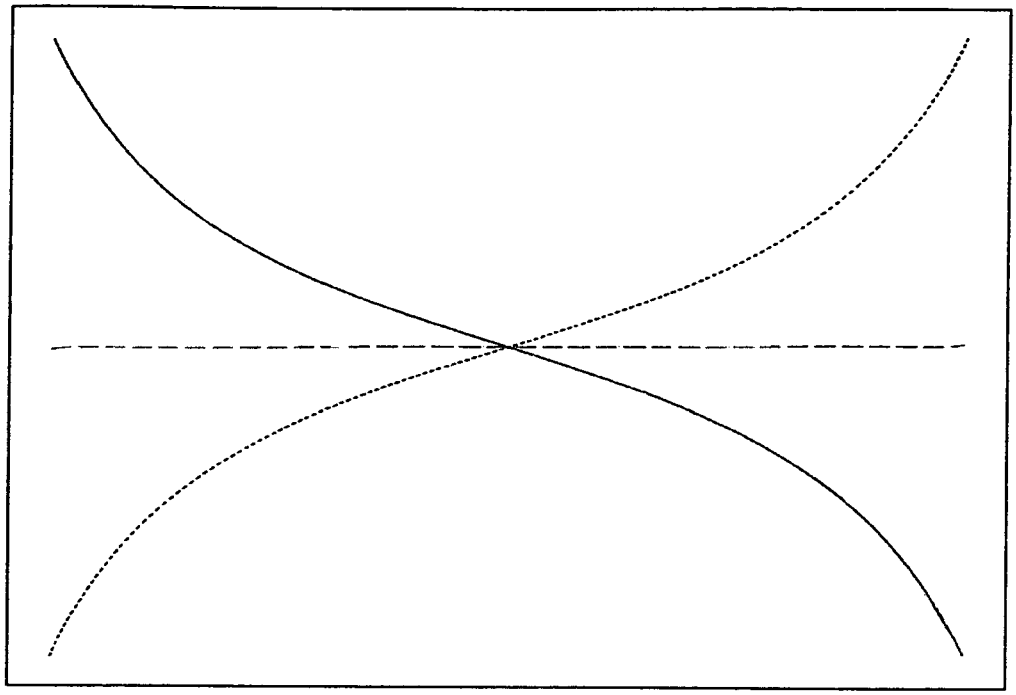
FIG. 20 shows the result obtained using a magnetostatic counterforce to provide adiabatic pressure compensation with the cam-free system of FIG. 19.

The solid trace in FIG. 20 is the resulting magnetic force as a function of piston position. The dotted trace is that of the pressure and the dashed trace is the vanishingly small sum of the two, indicating that the goal of countering the pressure forces has been accomplished.

In the isothermal case, the pressure on the piston can be shown to be given by the following equation:

$$\begin{aligned} p_i(x)A &= p_0A\left(1+\frac{x}{L_0}\right)^{-1} - p_0A \\ &\equiv F_i(x) \\ &= p_0A\left[\left(1+\frac{x}{L_0}\right)^{-1} - 1\right]. \\ &= F_0\left[\left(1+\frac{x}{L_0}\right)^{-1} - 1\right] \end{aligned} \tag{62}$$

Figure 21:
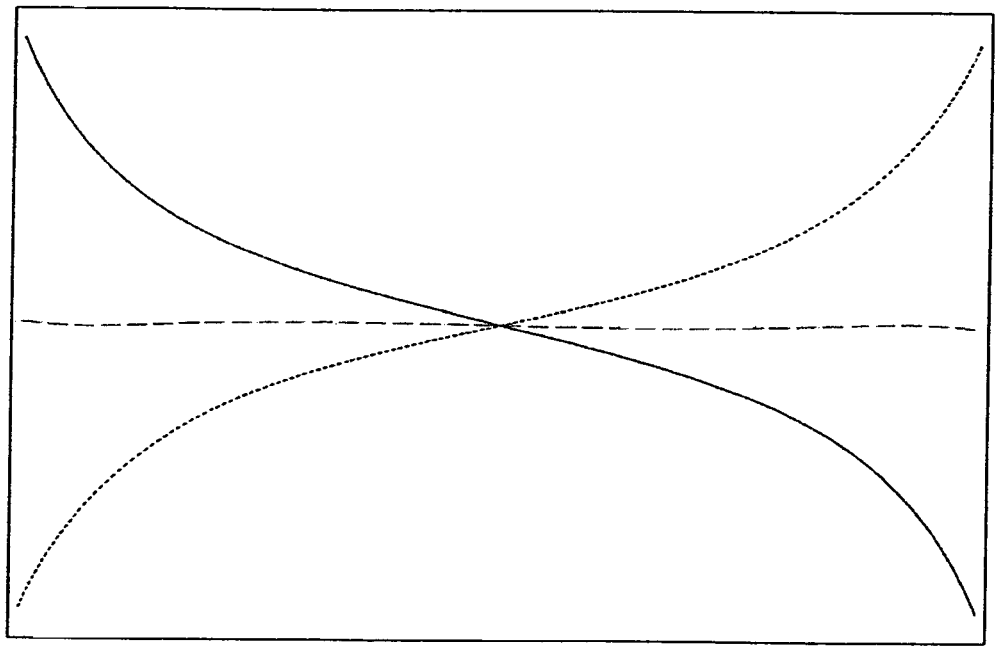
FIG. 21 shows the result obtained using a magnetostatic counterforce to provide isothermal pressure compensation with the cam-free system of FIG. 19.

From Equation 62, the following force expression is derived:

$$F_P(x) = \pi \cdot r_P^2 \cdot P_A \cdot \left[\left(1+\frac{2x}{\Delta}\right)^{-1} - \left(1-\frac{2x}{\Delta}\right)^{-1}\right], \tag{63}$$

which, too, needs to be matched by the force from Equation 59. This is, once again, subjected to a process of numerical optimization resulting in the successful outcome shown in the following Table 4 and in FIG. 21.

TABLE 4

| Cam-Free Isothermal Compensation Results | |
|---|---|
| $\frac{P_A \cdot (\mu+1)}{4 \cdot \pi \bullet M^2 (\mu - 1)}$ | 0.099 |
| $\frac{l_m}{L}$ | 0.345 |
| $\frac{r_m}{L}$ | 0.172 |
| $\frac{\Delta}{L}$ | 1.075 |

This particular implementation is especially important because it can apparently serve as the basis for [ft6]an isothermal heat engine. Conceptually, isothermal operation may be accomplished using a feedback mechanism where the surface area of a heat sink bathed in the gas of the engine is adjusted to maintain a constant gas temperature. Two such heat sinks are installed at each end of the engine shown in FIG. 19, one connected to a cold reservoir and the other connected to a hot one. To drive the piston, the cold sink in one end of the engine and the hot sink in the other are "disabled" while their companions are "activated." Once the piston reaches the end of the cylinder, the sinks are disabled and the alternates are activated. In keeping the temperature of the gas constant and countering the pressure forces, the internal energy change of the engine is identically zero, thereby meeting the requirement for an isothermal heat engine.

Cam-free counterforce mechanism implementation using non-magnetostatic forces follows an equivalent technique of design. However, these force profiles differ significantly from that of the magnetostatic arrangement. Therefore, the range of operation over which their unleveraged magnitude is substantially that of the pressure force to be countered may be reduced.

Figure 22:
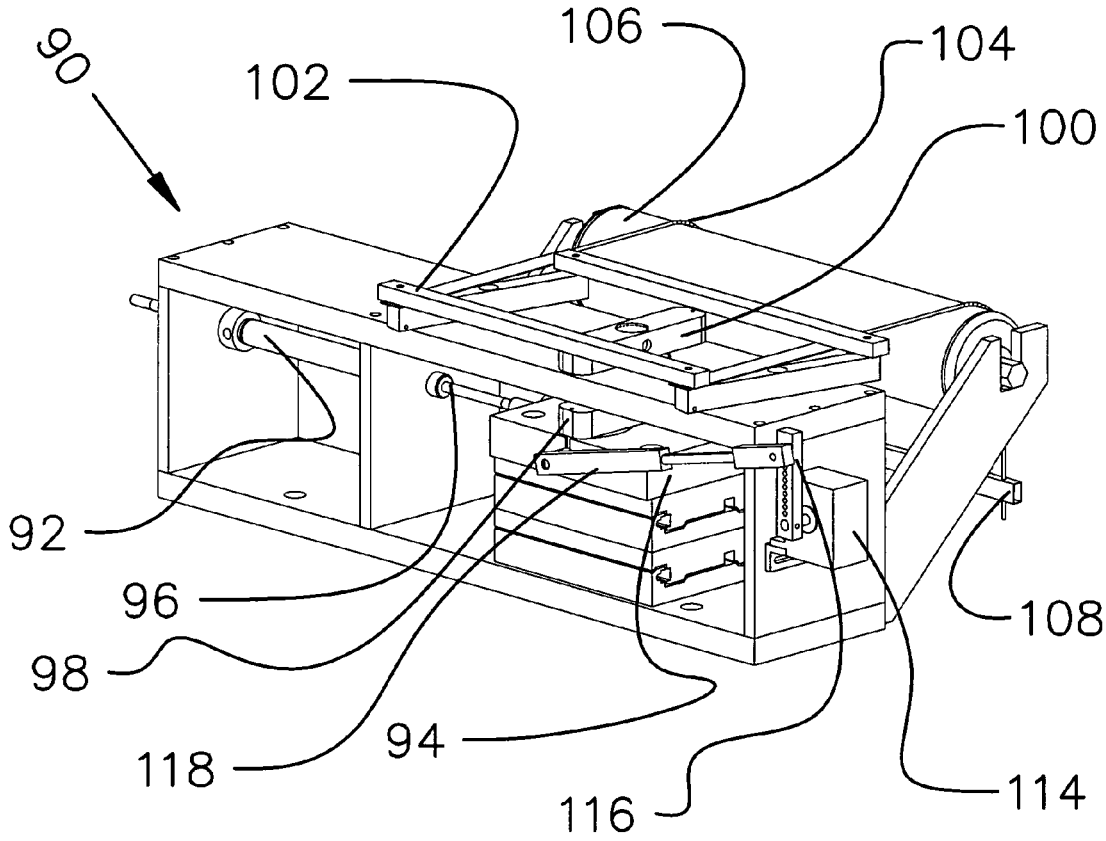
FIG. 22 is a perspective view of a cam-based device used to test the concept of the invention.

In order to test the effectiveness of compression compensation according to the invention in increasing device efficiency, a cam-based apparatus was used. As shown in FIG. 22, such a counterforce mechanism 90 included a double-acting cylinder 92 with a piston (not seen) rigidly attached to a cam assembly 94 via a connecting rod 96. As the piston moves within the cylinder 92, the cam translates along a similar linear path while a lever arm 98 tracks along the shaped surface of a cam plate (not shown).

As the lever arm 98 tracks the cam shape, a counterpart lever arm 100, mounted on the same shaft, rides along a parallel rail arrangement 102. As the lever arm 100 rotates, the parallel rails approach one another allowing a cable 104 to extend around an idler roller 106. A mass-attachment bar 108, from which a mass can be attached to provide the desired counterforce, is attached to the end of the cable 104.

Figure 23:
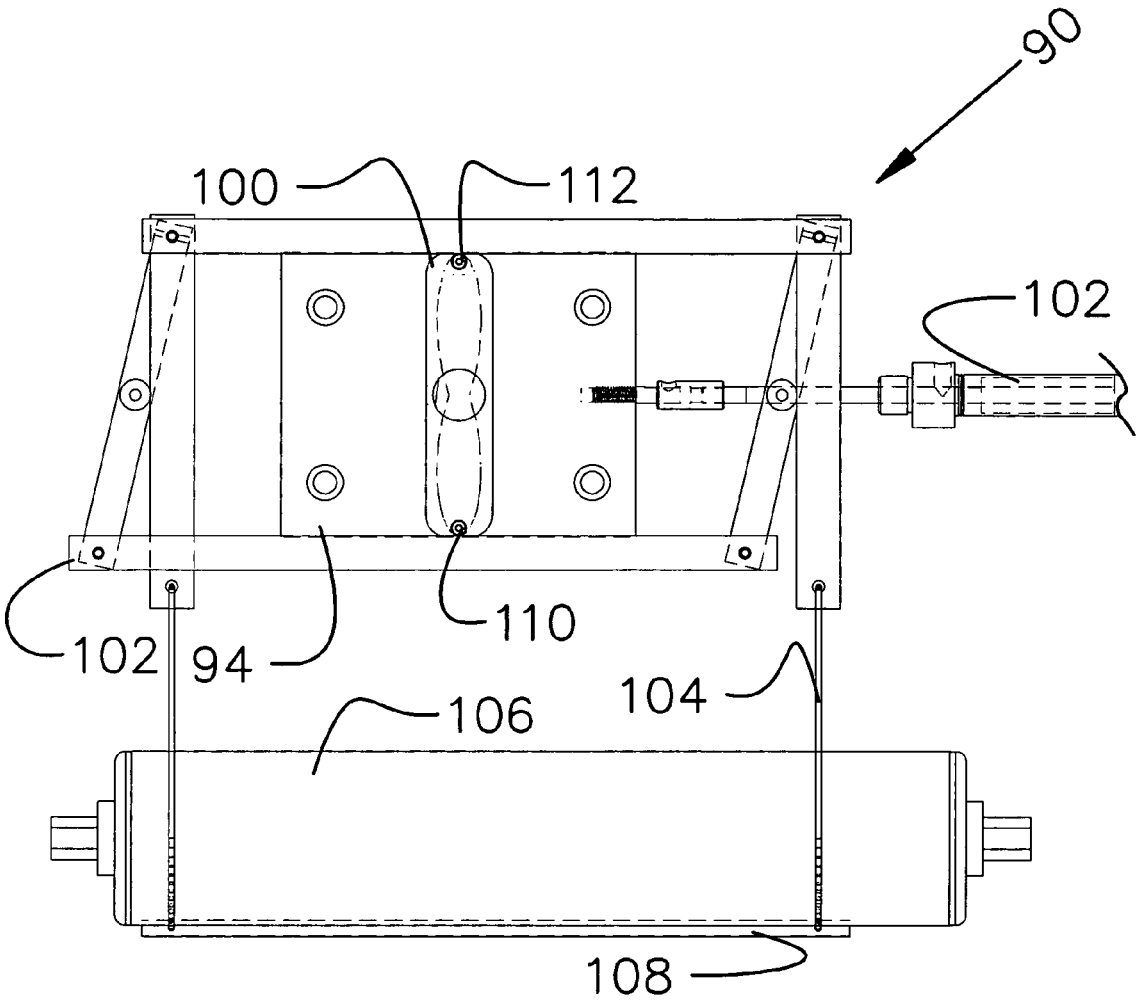
FIG. 23 is a top view of the device of FIG. 22.

FIG. 23 is a more detailed, top view of the counterforce mechanism 90 showing the lever-arm-mounted cam followers 110,112 and the cam shape itself (normally obscured by the lever arms). The shape of the cam is designed in a manner similar to the technique described earlier for gear-cam design.

Figure 24:
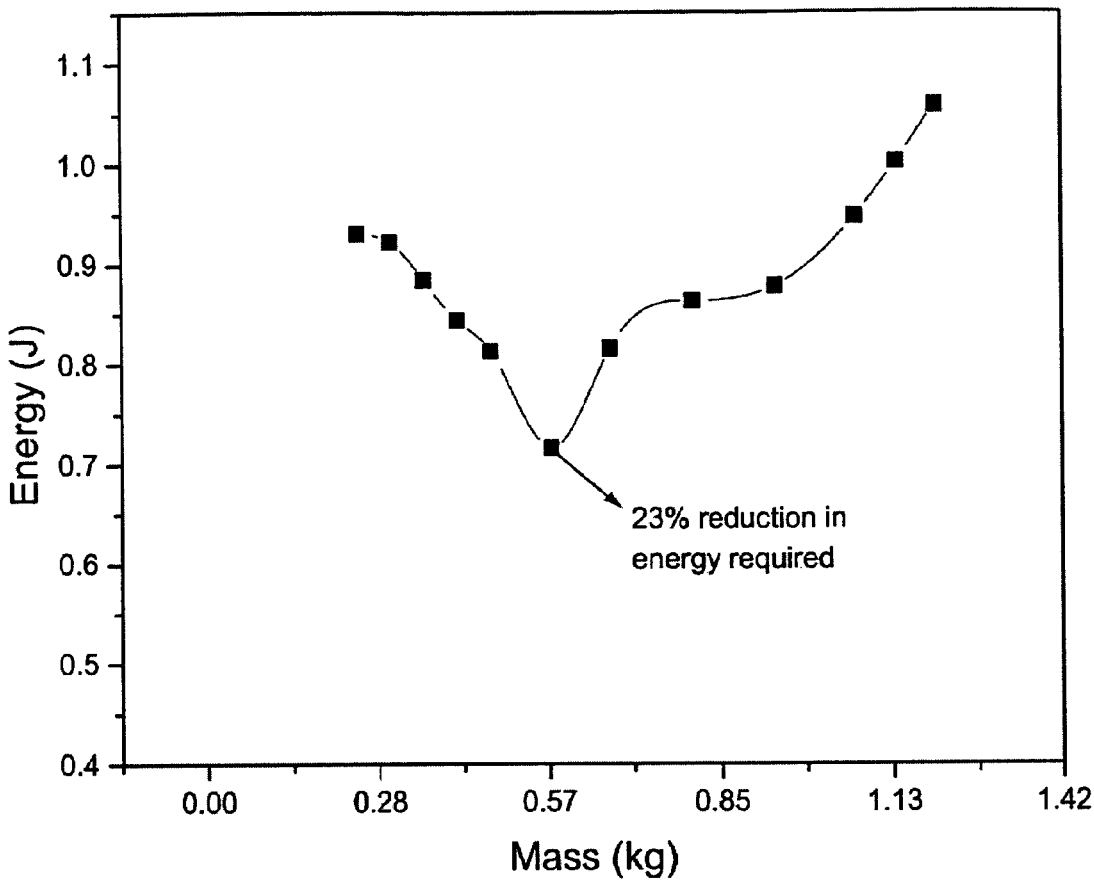
FIG. 24 is an energy-versus-mass plot showing the minimum raw energy required to run the device of FIG. 22 for a single cycle as a function of the mass used in the counterforce mechanism.
Figure 25:
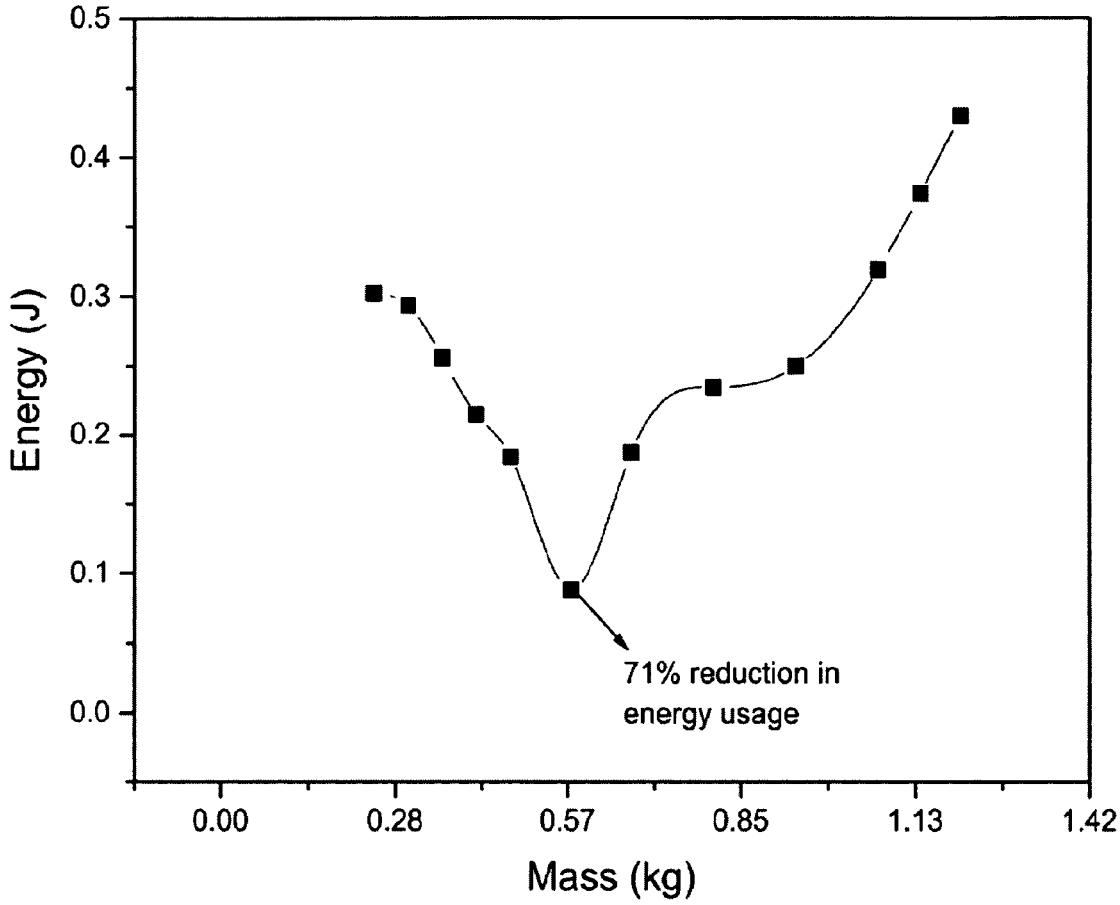
FIG. 25 shows the results of FIG. 24 with the frictional forces eliminated.

In order to test the theory of the invention using this experimental apparatus, a small drive motor 114 (FIG. 22) was used to drive the cam along its normal path via a crank 116 and pushrod 118 arrangement. The power required to turn the motor was monitored for a variety of counterforce weights attached to the bar 108. Based on the present invention, a certain counterforce weight was expected to exist that would correspond to a minimum power requirement to run the piston. FIGS. 24 and 25 illustrate the results of the experiment.

FIG. 24 identifies the minimum raw energy required to run the apparatus 90 for a single cycle as a function of the mass used in the counterforce mechanism. That is, for each weight attached to the bar 108, the energy required by the motor 114 to operate the mechanism at a predetermined speed [ft7] was measured. Clearly, this energy included a portion needed to overcome the frictional forces of the system, which are not part of the conservative forces that are the focus of the invention.

FIG. 25 shows the results of the experiment with the frictional forces eliminated. This was accomplished by first determining the energy required to operate the device with the double-acting cylinder unsealed, thereby eliminating all compression forces while still monitoring the energy required to overcome frictional forces. The result of this test found that 0.492 J was required to overcome the friction of the device over one cycle. Zero counterforce mass was used in the compression-less operation, so the counterforce-mechanism friction was not determined in that test. To make that determination, the device was operated using the minimum mass that still allowed the counterforce mechanism to operate. The difference between this and the energy required to operate the device with zero counterforce mass was then identified as the counterforce-mechanism friction. This was found to be 0.136 J per cycle.

The results shown in FIG. 25 are those of FIG. 24 after the two values of single-cycle friction were subtracted. It is clear from the experiment that the amount of energy lost in compressing the gas in this conservative-force system can be greatly reduced and, theoretically, eliminated through the use of a conservative compensation mechanism, contrary to the traditional view.

It is understood that the concept of the invention could be implemented in similar fashion to counterbalance any conservative force acting on a reciprocating member in a machine. Moreover, the invention has been described with reference to internal combustion engines, but it is clear that it is equally suitable for application to engines heated by some external means as well as compressors and refrigerators, all considered heat engines in the art, as discussed above. Such means of heating are well-known in the art to include chemical reactions, nuclear reactions, solar flux, and geothermal sources. Finally, it is well-known in the art that a common technique of transferring force, either modified or unmodified, from one place to another within an apparatus it to employ a hydraulic fluid. Inherent in this technique is the possibility of varying the cross-sectional area exposed to the hydraulic fluid in multiple locations in order to provide a mechanical advantage in direct correspondence with the use of a lever or a linkage in which moment arm lengths are varied. Therefore, for the purposes of this disclosure, the use of hydraulics is understood to be a suitable replacement to the use of a lever.

Therefore, while the invention has been shown and described in what is believed to be the most practical and preferred embodiments, it is recognized that departures can be made therefrom within the scope of the invention, which is not to be limited to the details disclosed but is to be accorded the full scope of the claims so as to embrace any and all equivalent apparatus and methods.

I claim:

1. In a reciprocating-piston engine that includes a gas exerting a conservative force on a piston resulting from a change in volume of the gas arising from a change in position of the piston during a cycle of operation of the engine, the improvement comprising a mechanism adapted to counter said conservative force with a counterforce acting on the piston, said counterforce being produced by a position-dependent force acting on the mechanism, wherein said counterforce is substantially equal in magnitude to said conservative force exerted on the piston at each point of said cycle of operation of the engine.

2. The improvement of claim 1, wherein said mechanism couples the position-dependent force directly to the piston.

3. The improvement of claim 1, wherein said mechanism includes a lever coupling the position-dependent force to the piston.

4. The improvement of claim 1, wherein said mechanism includes a linkage coupling the position-dependent force to the piston.

5. The improvement of claim 1, wherein said mechanism includes a cam coupling the position-dependent force to the piston.

6. The improvement of claim 1, wherein said mechanism includes a gear coupling the position-dependent force to the piston.

7. The improvement of claim 1, wherein said position-dependent force is produced by gravity.

8. The improvement of claim 1, wherein said position-dependent force is produced by a deformation of a material.

9. The improvement of claim 1, wherein said position-dependent force is produced by a permanent magnet.

10. The improvement of claim 1, wherein said position-dependent force is produced by a separation of electric charges.

11. The improvement of claim 1, wherein said position-dependent force is produced by a compression of a substance.

12. The improvement of claim 1, wherein said engine is an internal-combustion engine.

13. The improvement of claim 12, wherein said internal-combustion engine is a spark-ignition engine.

14. The improvement of claim 12, wherein said internal-combustion engine is a compression-ignition engine.

15. The improvement of claim 1, wherein heat is introduced into said engine from an external source.

16. The improvement of claim 15, wherein said external source is chemical in nature.

17. The improvement of claim 15, wherein said external source is nuclear in nature.

18. The improvement of claim 15, wherein said external source is geothermal in nature.

19. The improvement of claim 15, wherein said external source is solar radiation.

20. In a reciprocating-piston refrigerator that includes a gas exerting a conservative force on a piston resulting from a change in volume of the gas arising from a change in position of the piston during a cycle of operation of the refrigerator, the improvement comprising a mechanism adapted to counter said conservative force with a counterforce acting on the piston, said counterforce being produced by a position-dependent force acting on the mechanism; wherein said counterforce is substantially equal in magnitude to said conservative force exerted on the piston at each point of said cycle of operation of the refrigerator.

21. The improvement of claim 20, wherein said mechanism couples the position-dependent force directly to the piston.

22. The improvement of claim 20, wherein said mechanism includes a lever coupling the position-dependent force to the piston.

23. The improvement of claim 20, wherein said mechanism includes a linkage coupling the position-dependent force to the piston.

24. The improvement of claim 20, wherein said mechanism includes a cam coupling the position-dependent force to the piston.

25. The improvement of claim 20, wherein said mechanism includes a gear coupling the position-dependent force to the piston.

26. The improvement of claim 20, wherein said position-dependent force is produced by gravity.

27. The improvement of claim 20, wherein said position-dependent force is produced by a deformation of a material.

28. The improvement of claim 20, wherein said position-dependent force is produced by a permanent magnet.

29. The improvement of claim 20, wherein said position-dependent force is produced by a separation of electric charges.

30. The improvement of claim 20, wherein said position-dependent force is produced by a compression of a substance.

31. In a reciprocating-piston compressor that includes a gas exerting a conservative force on a piston resulting from a change in volume of the gas arising from a change in position of the piston during a cycle of operation of the compressor, the improvement comprising a mechanism adapted to counter said conservative force with a counterforce acting on the piston, said counterforce being produced by a position-dependent force acting on the mechanism; wherein said counterforce is substantially equal in magnitude to said conservative force exerted on the piston at each point of said cycle of operation of the compressor.

32. The improvement of claim 31, wherein said mechanism couples the position-dependent force directly to the piston.

33. The improvement of claim 31, wherein said mechanism includes a lever coupling the position-dependent force to the piston.

34. The improvement of claim 31, wherein said mechanism includes a linkage coupling the position-dependent force to the piston.

35. The improvement of claim 31, wherein said mechanism includes a cam coupling the position-dependent force to the piston.

36. The improvement of claim 31, wherein said mechanism includes a gear coupling the position-dependent force to the piston.

37. The improvement of claim 31, wherein said position-dependent force is produced by gravity.

38. The improvement of claim 31, wherein said position-dependent force is produced by a deformation of a material.

39. The improvement of claim 31, wherein said position-dependent force is produced by a permanent magnet.

40. The improvement of claim 31, wherein said position-dependent force is produced by a separation of electric charges.

41. The improvement of claim 31, wherein said position-dependent force is produced by a compression of a substance.

42. A machine comprising:

a reciprocating piston;

a gas exerting a conservative force on the piston as a result of a change of volume in the gas as the piston moves along a predetermined path of motion during a cycle of operation of the machine;

means for producing a position-dependent force; and means for coupling said position-dependent force to the piston to counter said conservative force with a counterforce as the piston moves along said path of motion; wherein said counterforce is substantially equal in magnitude to the conservative force exerted by the gas on the piston at each point along said path of motion of the piston during the cycle of operation of the machine.

43. The machine of claim 42, wherein said means for producing a position-dependent force includes gravity.

44. The machine of claim 42, wherein said means for producing a position-dependent force includes a deformation of a material.

45. The machine of claim 42, wherein said means for producing a position-dependent force includes a permanent magnet.

46. The machine of claim 42, wherein said means for producing a position-dependent force includes a separation of electric charges.

47. The machine of claim 42, wherein said means for producing a position-dependent force includes a compression of a substance.

48. The machine of claim 42, wherein said coupling means includes a lever.

49. The machine of claim 42, wherein said coupling means includes a linkage.

50. The machine of claim 42, wherein said coupling means includes a cam.

51. The machine of claim 42, wherein said coupling means includes a fear.

52. The machine of claim 42, wherein said machine is a reciprocating-piston engine.

53. The machine of claim 42, wherein said machine is a reciprocating-piston refrigerator.

54. The machine of claim 42, wherein said machine is a reciprocating-piston compressor.

55. The machine of claim 42, wherein said machine is an internal-combustion engine, said counterforce is substantially equal in magnitude to the conservative force at each point along said path of motion of the piston, said coupling means includes a cam; and said means for producing a position-dependent force includes a spring.

56. A mechanism for coupling to a reciprocating-piston machine wherein a change in position of a piston produces a change in volume of a gas and in a corresponding conservative force acting on the piston during a cycle of operation of the machine, comprising:

a source of a position-dependent force; and a coupler converting said position dependent force into a counterforce opposing said conservative force acting on the piston; wherein said counter-force is substantially equal in magnitude to said conservative force acting on the piston at each point of said cycle of operation of the machine.

57. The mechanism of claim 56, wherein said source of a position-dependent force includes gravity.

58. The mechanism of claim 56, wherein said source of a position-dependent force includes a spring.

59. The mechanism of claim 56, wherein said source of a position-dependent force includes a permanent magnet.

60. The mechanism of claim 56, wherein said source of a position-dependent force includes a separation of electric charges.

61. The mechanism of claim 56, wherein said source of a position-dependent force includes a compression of a substance.

62. The mechanism of claim 56, wherein said coupler includes a lever.

63. The mechanism of claim 56, wherein said coupler includes a linkage.

64. The mechanism of claim 56, wherein said coupler includes a cam.

65. The mechanism of claim 56, wherein said coupler includes a gear.

66. The mechanism of claim 56, wherein said coupler includes a hydraulic component.

67. The mechanism of claim 56, wherein said reciprocating-piston machine is an internal-combustion engine, said coupler includes a cam; and said source includes a spring.

68. A method for improving the efficiency of a heat engine that includes a gas exerting a conservative force on a piston resulting from a change in volume of the gas arising from a change in position of the piston during a cycle of operation of the heat engine, the method comprising the step of countering said conservative force with a counterforce acting on the piston, wherein said counterforce is produced by a position-dependent force; and wherein said counterforce is substantially equal in magnitude to said conservative force exerted on the piston at each point of said cycle of operation of the heat engine.

69. The method of claim 68, wherein said position-dependent force is produced by gravity.

70. The method of claim 68, wherein said position-dependent force is produced by a deformation of a material.

71. The method of claim 68, wherein said position-dependent force is produced by a permanent magnet.

72. The method of claim 68, wherein said position-dependent force is produced by a separation of electric charges.

73. The method of claim 68, wherein said position-dependent force is produced by a compression of a substance.

74. The method of claim 68, wherein said heat engine is a reciprocating-piston engine.

75. The method of claim 68, wherein said heat engine is a reciprocating-piston refrigerator.

76. The method of claim 68, wherein said heat engine is a reciprocating-piston compressor.

* * * * *